US011525576B2

(12) United States Patent
Basdeo et al.

(10) Patent No.: US 11,525,576 B2
(45) Date of Patent: Dec. 13, 2022

(54) LIGHTER DEVICE HAVING ACCESSORY STORAGE

(71) Applicant: Surface Fabrication and Designs, Corp., Bayside, NY (US)

(72) Inventors: Daniel S. Basdeo, New York, NY (US); Sanjay Mahadeo, New York, NY (US)

(73) Assignee: Surface Fabrication and Designs, Corp., Bayside, NY (US)

( * ) Notice: Subject to any disclaimer, the term of this patent is extended or adjusted under 35 U.S.C. 154(b) by 23 days.

(21) Appl. No.: 17/323,662

(22) Filed: May 18, 2021

(65) Prior Publication Data

US 2021/0270461 A1 Sep. 2, 2021

Related U.S. Application Data

(62) Division of application No. 16/257,954, filed on Jan. 25, 2019, now abandoned.

(51) Int. Cl.

| | |
|---|---|
| ***A24F 15/10*** | (2006.01) |
| ***B65D 85/10*** | (2006.01) |
| ***F23Q 2/36*** | (2006.01) |
| ***F23Q 2/32*** | (2006.01) |
| ***A24F 15/18*** | (2006.01) |
| ***F23Q 1/06*** | (2006.01) |

(52) U.S. Cl.

CPC ..... *F23Q 2/36* (2013.01); *A24F 15/18* (2013.01); *F23Q 1/06* (2013.01); *F23Q 2/32* (2013.01)

(58) Field of Classification Search

CPC . A24F 15/10; A24F 15/18; F23Q 2/32; F23Q 2/36; F23Q 1/06

USPC ..... 206/38, 85, 86, 235, 385, 581; 132/294, 132/317, 318; 401/52, 195; 431/253

See application file for complete search history.

(56) References Cited

U.S. PATENT DOCUMENTS

| | | | | |
|---|---|---|---|---|
| 2,815,123 | A | 12/1957 | Safianoff | |
| 3,179,891 | A | 4/1965 | Sharma | |
| 4,992,042 | A * | 2/1991 | Knuepfer | F23Q 2/32 206/385 |
| 5,226,541 | A | 7/1993 | Huang | |
| 5,513,754 | A * | 5/1996 | Chang | A45C 11/008 206/581 |
| 7,717,259 | B2 | 5/2010 | Hatton | |
| 2006/0288169 | A1* | 12/2006 | Steiner | F23Q 2/32 711/115 |
| 2007/0023559 | A1 | 2/2007 | Scapillato et al. | |
| 2009/0046452 | A1 | 2/2009 | Huang et al. | |
| 2010/0136494 | A1* | 6/2010 | Connolly | F23Q 2/32 431/253 |
| 2014/0030664 | A1* | 1/2014 | Maimon | F23Q 2/345 431/253 |
| 2015/0167976 | A1* | 6/2015 | Recio | G06F 1/182 219/209 |
| 2016/0201905 | A1* | 7/2016 | Villareal | F23Q 1/02 431/273 |
| 2017/0356651 | A1* | 12/2017 | Hodge | B65D 43/22 |

* cited by examiner

*Primary Examiner* — Luan K Bui
(74) *Attorney, Agent, or Firm* — NovoTechIP International PLLC

(57) ABSTRACT

A device comprises a main body having a first, lighter portion and a second portion. The lighter portion is configured to house a lighter mechanism capable of igniting a flame. The second portion contains a pocket accessible from outside the main body and is configured to receive an accessory.

20 Claims, 23 Drawing Sheets

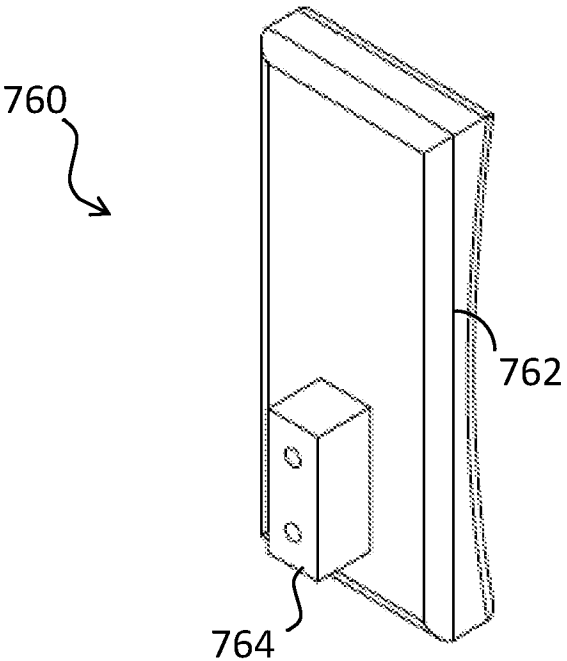
FIG. 7B
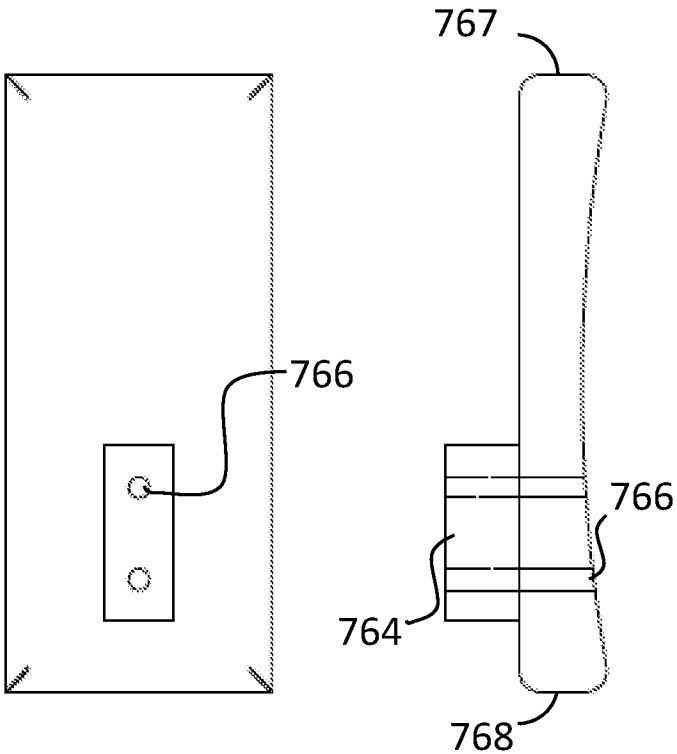
FIG. 7D
FIG. 7C

LIGHTER DEVICE HAVING ACCESSORY STORAGE

CROSS-REFERENCE TO RELATED APPLICATIONS

This application is a divisional application of U.S. patent application Ser. No. 16/257,954 entitled "LIGHTER DEVICE HAVING ACCESSORY STORAGE," filed Jan. 25, 2019, which is currently co-pending.

BACKGROUND

Numerous types of lighters are known in the art. Lighters can be divided into two main categories: 1) mechanical lighters that burn lighter fluid to generate a flame; and 2) electric lighters that can light a flame using electricity. In the first category, some lighters (such as Zippo®) are refillable. These lighters include naphtha as the lighter fluid and use a flint to light. They may be designed so that the user does not need to keep his/her finger on the lighter activator in order to keep the flame lit. Another type lighter in the first category (such as Bic®) is not refillable. Bic® lighters are typically designed to be disposable and contain butane as the lighter fluid. The user may have to keep his/her finger on the lighter activator in order to keep the flame lit.

Lighters in the second category do not use lighter fluid. Rather, electric lighters may generate one or more electrical arcs between a pair of electrodes. This arc may be hotter than a traditional flame. Electric lighters may be rechargeable via USB connection.

Cosmetic products such as lip balms and lipsticks come in many forms and shapes. Some lip balms, such as Chapstick® often come in a stick form and dispenser similar to lipstick. Lip balms may also come in other forms such as balls or squeeze bottles.

BRIEF DESCRIPTION OF THE DRAWINGS

FIG. 5E also shows the cap shown in FIG. 5A in a position for installation onto the combination device.

FIG. 7B is a perspective view of an example of an actuator component of an advancer mechanism such as the advancer mechanism shown in FIG. 7A.

FIG. 7C is a side view of the actuator shown in FIG. 7B.

FIG. 7D is a front view of the actuator shown in FIG. 7B.

DETAILED DESCRIPTION

Figures 1A, 1B, 1C, 1D, 1E:
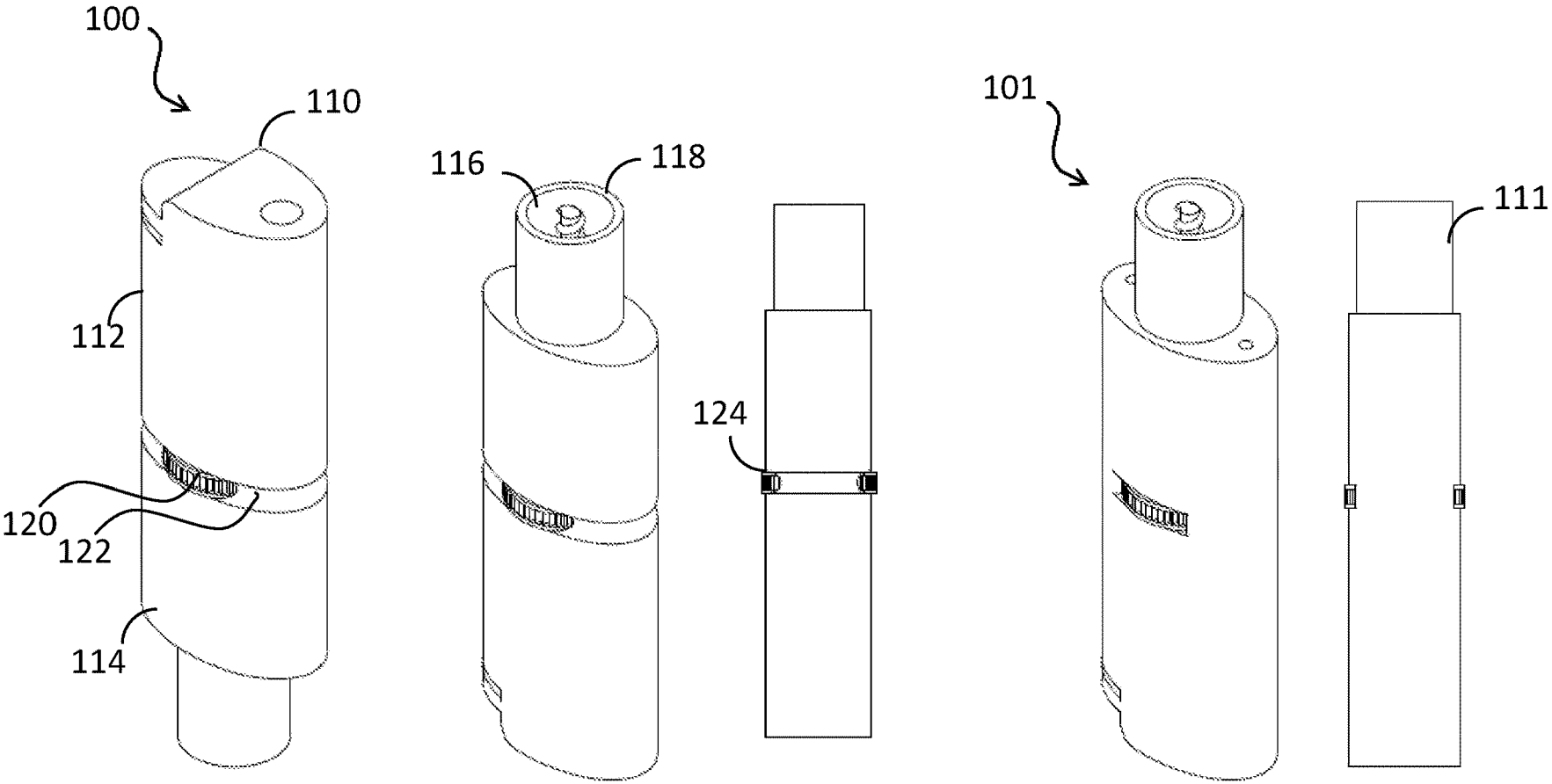
FIG. 1A is a perspective view of an example of a combination device that has a first, lighter portion and a second portion, viewed from the perspective of the lighter portion.
FIG. 1B is a perspective view of the example of the combination device viewed from the perspective of the second portion.
FIG. 1C is a front view of the example of the combination device shown in FIG. 1B.
FIG. 1D is a perspective view of another example of the combination device.
FIG. 1E is a front view of the example of the combination device shown in FIG. 1D.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry may have been described at a relatively high-level, without detail, in order to avoid unnecessarily obscuring aspects of the present teachings.

Also, throughout the drawings, a particular device or component may be shown in multiple views such as a three-dimensional perspective view and/or two-dimensional front, rear, side, top-plan or bottom-plan views. Not all surfaces or elements of the device or component will necessarily be shown in the drawings. Hidden or inner surfaces may or may not be shown in a particular drawing. For clarity of understanding, sometimes certain inner surfaces or elements are shown, and sometimes only outer surfaces are shown. When hidden or inner surfaces are shown in the drawings, they are drawn using broken lines.

This disclosure pertains to a combination device that is a lighter and also has a pocket that can receive an accessory. In this disclosure, the device may be referred to as "the combination device" or simply "the device." The device includes a main body having a first, lighter portion housing a lighter mechanism capable of lighting a flame. The main body also has a second portion containing a pocket. The pocket is accessible from outside the main body and is configured to receive an accessory. In many examples, the accessory may be a cosmetic product. In some of these examples, the pocket may have a dispensing opening, and the second portion of the main body may be a dispenser portion that can dispense the cosmetic product through the dispensing opening. In some examples, the device may include the cosmetic product in the pocket. In some examples, the device may include a means for dispensing the cosmetic product such as the spindle or slider mechanisms described in detail below.

The device may have a number of configurations. In many examples, the lighter portion is at one end of the device, and the dispenser portion is at the opposite end of the device. In some examples, the lighter portion and the dispenser portion may be integral portions of one main body. In other examples, as described later below, there may be a dispenser body removably coupled to a lighter body instead of having the lighter and dispenser as portions of one integral body.

FIGS. 1A-1E illustrate examples of the device where the lighter portion and the dispenser portions are integral to the main body. FIGS. 1A-1C are different views of the same device. FIG. 1A is a perspective view showing the lighter portion at the top of the device and the dispenser portion at the bottom of the device. FIG. 1B shows the same device in an opposite orientation to that of FIG. 1A. In FIG. 1B, the dispenser portion is shown at the top of the device and the lighter portion is shown at the bottom of the device. In many places throughout the present disclosure, the orientation of FIG. B will be used when referring to the "top," "bottom," "front," "rear," and "side" views of the device. However, these terms are for reference only; the device can be viewed, rotated, and/or oriented in any direction. FIG. 1C is a front view of the example combination device shown in FIG. 1B.

As will be described in greater detail below, the combination device 100 includes a main body 110. The main body 110 has a lighter portion 112 and a dispenser portion 114. The lighter portion 112 is configured to house a lighter mechanism capable of lighting a flame. The lighter mechanism can take various forms in different examples of the combination device. In some examples, the lighter portion 112 may contain lighter fluid, and the lighter mechanism is configured to light the lighter fluid to produce a flame. Some examples of lighter fluids that may be used are butane and naphtha. In some examples, the lighter mechanism may include a flint.

In other examples, the lighter mechanism can be an electric or electronic lighter such as a plasma lighter. In these examples, the lighter mechanism includes circuitry capable of producing an electric arc or other heat source for lighting a flame electronically. In some of these examples, the lighter portion may include a USB port (not shown) for recharging the lighter mechanism. In some of these examples, the lighter mechanism may generate a single or double arc plasma flame.

The lighter mechanism is not limited to the above examples. Rather, it can be any lighter mechanism known in the art. As such, the lighter mechanism is not described herein in great detail.

The dispenser portion 114 has a dispensing opening 116 through which a cosmetic product contained within the dispenser portion 114 can be dispensed. In some examples, the dispensing opening 116 may be at or towards the top end 118 of the dispenser portion 114. Opposing the top end 118, the bottom end of the dispenser portion may be proximate the lighter portion 112 of the main body 110. In many examples, the cosmetic product may be a lip balm, a lipstick, or a lip gloss. However, the cosmetic product is not limited to these examples. An advancer mechanism such as a spindle or slider may be integrated into the dispenser portion 114. The advancer mechanism may be configured to advance the cosmetic product to protrude from the dispensing opening 116.

The advancer mechanism may take different forms. The examples in FIGS. 1A-1E include a spindle (described in greater detail with respect to FIGS. 3A-3C) as the mechanism. Another example of the advancer mechanism is a slider (shown in FIGS. 6A-7G). However, the advancer mechanism is not limited to the spindle and the slider; rather, it may take any shape that can advance the cosmetic product to protrude from the dispensing opening 116. The advancer mechanism may be configured to advance the cosmetic product in a forward direction towards the top end 118 of the dispenser portion 114 and through the dispensing opening 116. In some examples, the advancer mechanism may also be configured to retract the cosmetic product back through the dispensing opening 116 in a reverse direction opposite that of the forward direction.

In FIGS. 1A-1E, rotation head 120 of the spindle protrudes from the sides of the main body at or towards the bottom end of the dispenser portion 114. However, the rotation head 120 may be alternatively be located elsewhere in the dispenser portion 114 (such as near the top of the dispenser portion). The bottom end of the dispenser portion 114 is proximate the lighter portion 112. FIGS. 1A-1C illustrate a groove 122 in the main body 110 near the rotation head 120. In these examples, the groove 122 may include an opening 124 in the main body 110 for receiving the rotation head 120. However, some examples such as device 101 in FIGS. 1D-1E may not contain this groove in the main body 111. In those examples, opening 124 for the rotation head 120 may be in a part of main body 111 that does not include a groove. In some examples, such as the examples shown in FIGS. 1D-1E, the outer surface of the main body 110 adjacent the opening 124 may be flush with the outer surface of the rest of the main body 110.

FIGS. 2A-2D illustrate the main body 210 (corresponding to main body 110 in FIGS. 1A-1C) with lighter portion 212 and dispenser portion 214. In some examples, the dispenser portion 214 has a neck 217 for insertion into a cap, as described below with reference to FIGS. 4A-5E. The diameter of the neck 217 may be narrower than the diameter of the bottom part 219 of the dispenser portion 214. Alternatively, the dispenser portion 214 may have a substantially uniform diameter throughout.

Figure 2C:
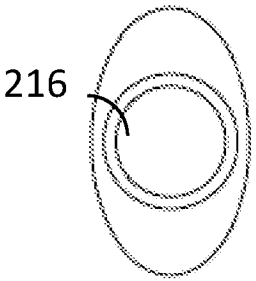
FIG. 2C is a top plan view of the main body shown in FIG. 2A.
Figure 2D:
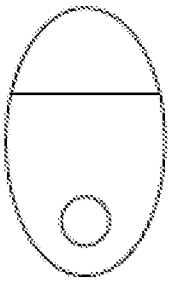
FIG. 2D is a bottom plan view of the main body shown in FIG. 2A.
Figure 2B:
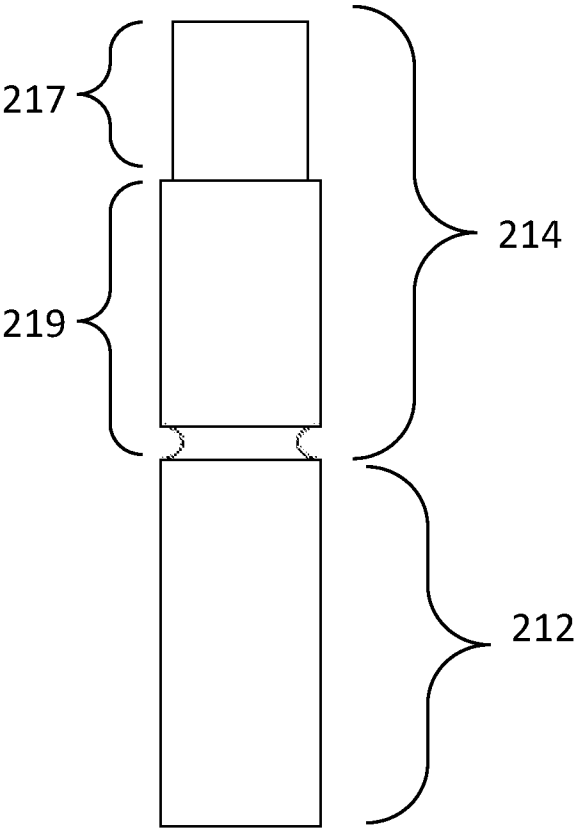
FIG. 2B is a front view of the main body shown in FIG. 2A.
Figure 2A:
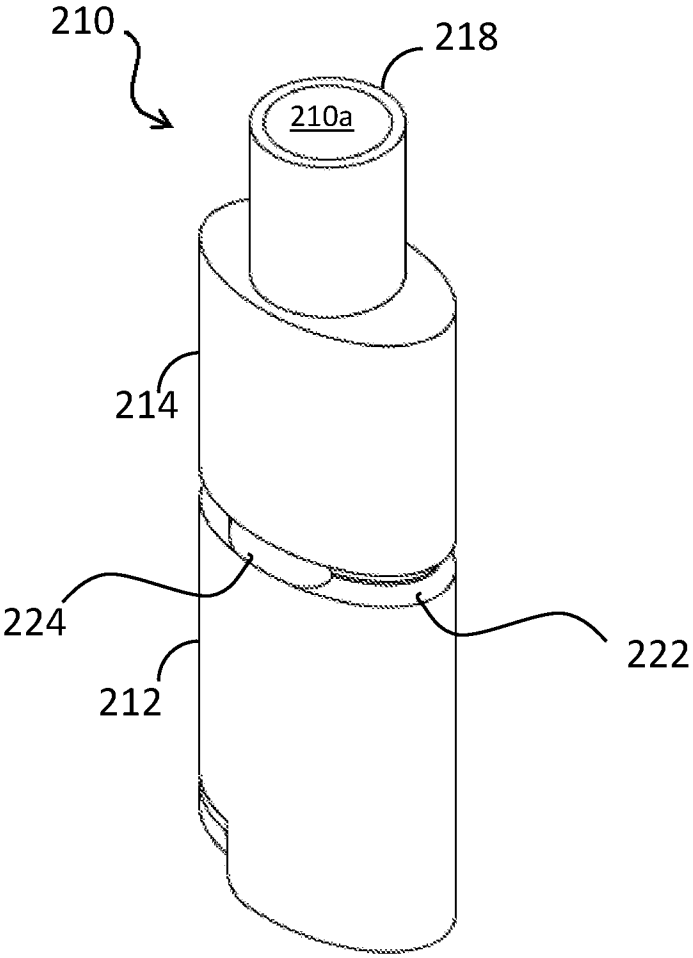
FIG. 2A is a perspective view of an example of a main body of the example combination device viewed from the perspective of the second portion.

FIGS. 2A and 2B show opening 224 towards the bottom of dispenser portion 214. The opening 224 allows the rotation head 120 of the spindle to protrude so that a user can rotate the head 120 to advance or retract the cosmetic product through the dispensing opening 216. While FIGS. 2A and 2B show groove 222 in the main body 210, as discussed above, this groove may not be present in some examples of the combination device (such as device 101 in FIGS. 1D-1E). Examples that do not include a groove 222 may still include an opening 224 in the main body 210 for the rotation head 120.

The opening 224 for rotation head 120 (and the groove 222, if provided), are not necessarily located at the exact location depicted in the drawings. The lighter portion 212 may be longer than the dispenser portion 214, or the dispenser portion 214 may be longer than the lighter portion 212. While all features in the drawings are shown approximately to scale of some examples of the device, the features of other examples may have different relative proportions than the examples illustrated in the drawings. The difference in size of various features described below may be greater or less than shown in the drawings.

In some examples, the cosmetic product within the dispenser portion 214 may rest directly on the rotation head 120. While FIG. 2A shows only a small portion of the interior vertical surface 210*a* that is visible through the dispensing opening 216 when there is no cosmetic product installed in the main body 210, the interior vertical surface 210*a* refers to the entire (or at least most of) the inner vertical surfaces of the dispenser portion 214 of the main body 210. In some examples, when the cosmetic product is in the main body 210, the cosmetic product may be in contact with or substantially adjacent the interior vertical surface 210*a*.

Figure 3A:
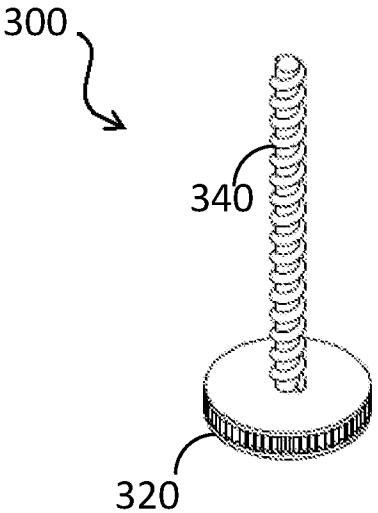
FIG. 3A is a perspective view of a first embodiment of an advancer mechanism of the example combination device.
Figure 3B:
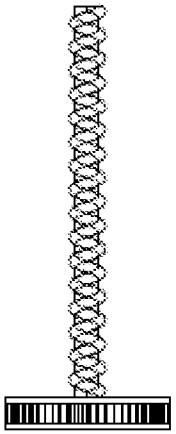
FIG. 3B is a front view of the advancer mechanism shown in FIG. 3A.
Figure 3C:
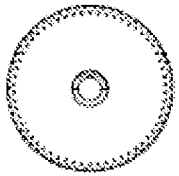
FIG. 3C is a top plan view of the advancer mechanism shown in FIG. 3A.

FIGS. 3A-3C show a spindle 300 as one example advancer mechanism. The spindle 300 may have a rotation head 320 (corresponding to rotation head 120 discussed previously) and a shaft 340 protruding from the rotation head 320. In certain examples, the rotation head 320 may be installed at the bottom end of the dispenser portion 114, and the shaft 340 may extend inside the dispenser portion 114 from the rotation head 320 towards the dispensing opening 116. In some examples, the shaft 340 may have a screw-type thread or threads that engage with the cosmetic product or with a sliding sleeve (not shown) for a cosmetic product. In these examples, turning (rotating) the rotation head 320 advances the cosmetic product in a forward direction towards the top end 118 of the dispenser portion 114 to protrude from the dispensing opening 116. The rotation head 320 may also be turned in the opposite direction to retract the cosmetic product back through the dispensing opening 116 towards the bottom of dispenser portion 114. For example, turning the rotation head 320 counter-clockwise may advance the cosmetic product, and turning the rotation head 320 clockwise may retract the cosmetic product, or vice versa.

In certain examples, rotation head 320 and shaft 340 may be manufactured as two separate components. In these examples, when manufacturing combination device 100, rotation head 320 may be placed in main body 210 by sliding the rotation head 320 into the opening 224. In these examples, the shaft 340 may be inserted into the main body 210 via the dispensing opening 216. Upon assembly, the shaft 340 is coupled to the rotation head 320 of the spindle 300. The coupling of the shaft 340 and the rotation head 320 may be performed by any means known in the art, such as, but not limited to, the following examples. They may be joined using epoxy, they may be heat-joined, or they may simply click into place.

In other examples, the spindle 300 may be manufactured as one piece, or the rotation head 320 and shaft 340 may be coupled before insertion into the main body 210. In these examples, the main body 210 may be manufactured in more than one piece, or the main body 210 may be shaped in a form that allows a spindle 300 to be inserted whole into the main body 210. The combination device 100 of this disclosure is not limited to any single method of manufacture.

Figure 4C:
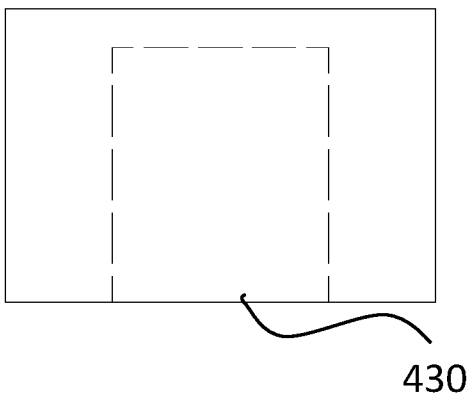
FIG. 4C is a side view of the cap shown in FIG. 4A.
Figure 4A:
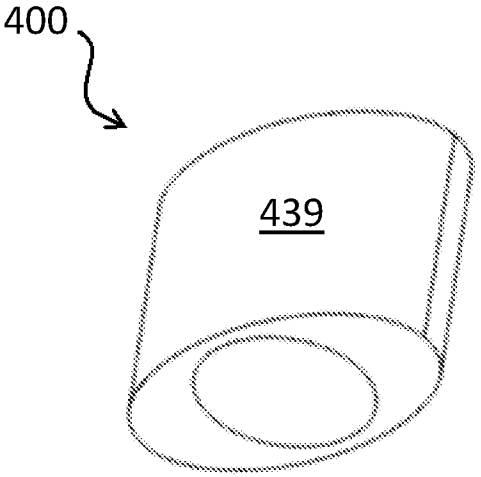
FIG. 4A is a perspective view of an example of a cap of the example combination device.
Figure 4B:
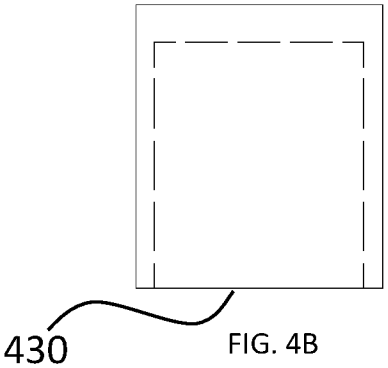
FIG. 4B is a front view of the cap shown in FIG. 4A.
Figure 4D:
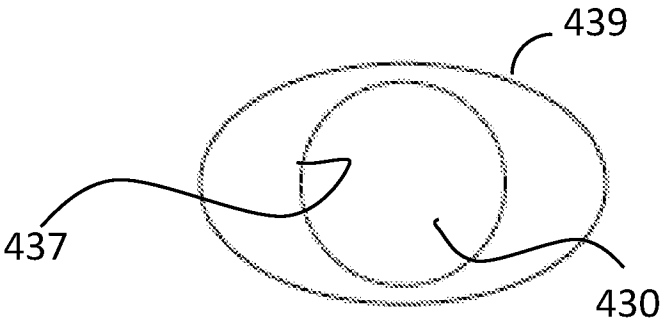
FIG. 4D is a bottom plan view of the cap shown in FIG. 4A.
Figure 4E:
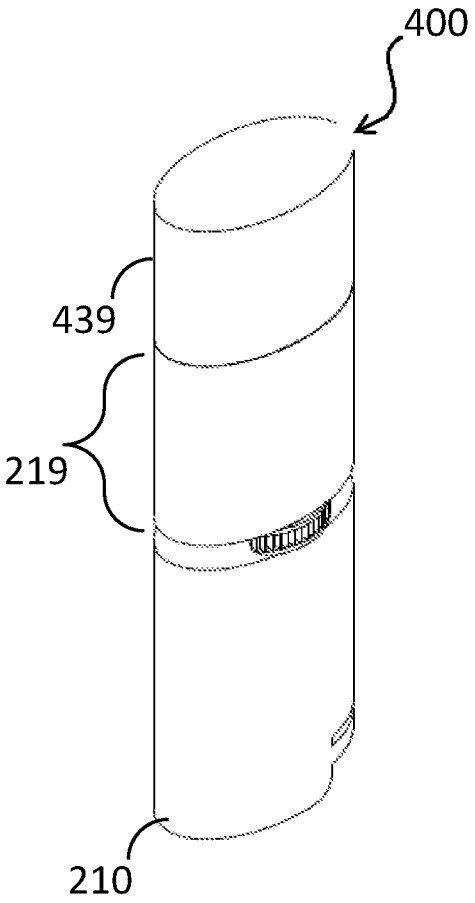
FIG. 4E is a perspective view of the cap shown in FIG. 4A installed onto the combination device shown in FIG. 1A.
Figure 5C:
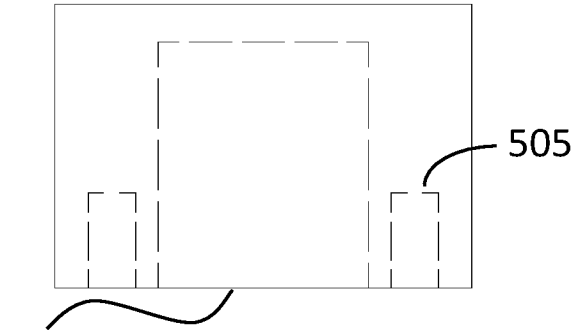
FIG. 5C is a side view of the cap shown in FIG. 5A.
Figure 5A:
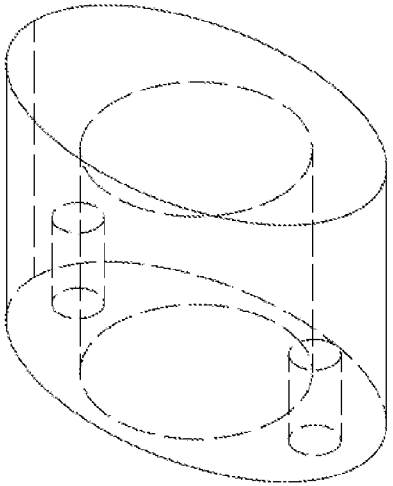
FIG. 5A is a perspective view of an example of a cap having pockets configured to hold magnets.
Figure 5B:
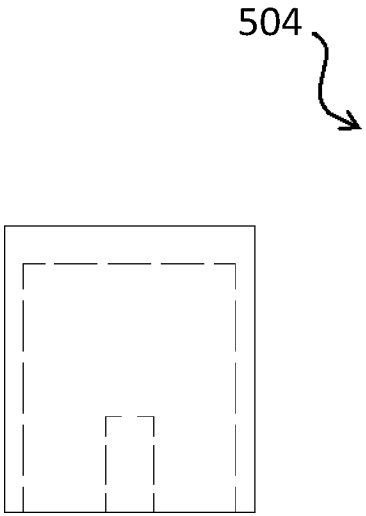
FIG. 5B is a front view of the cap shown in FIG. 5A.
Figure 5D:
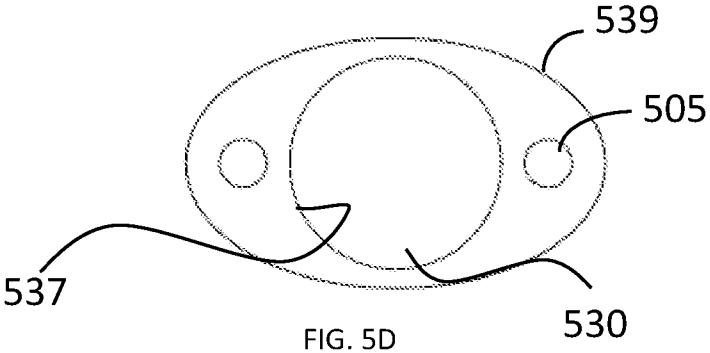
FIG. 5D is a bottom plan view of the cap shown in FIG. 5A.
Figure 5E:
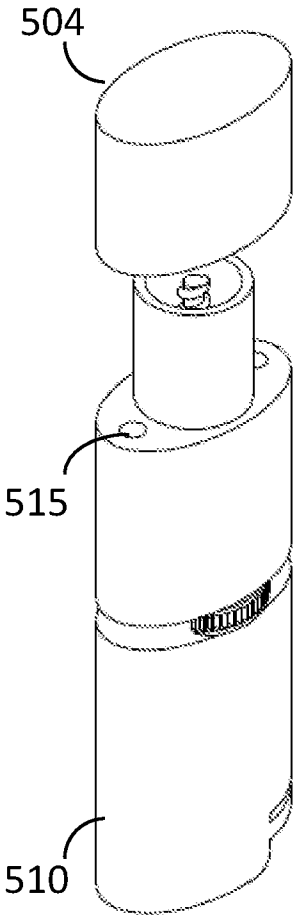
FIG. 5E is a perspective view of an example of the combination device having magnetic components corresponding to those on the cap.

FIGS. 4A-4D are different views of a removable cap 400 configured to cover the dispensing opening 116 of the device 100. Broken lines in front view FIG. 4B and side view FIG. 4C represent inner surfaces of the cap 400. FIG. 4E shows the cap 400 installed on the main body 210. The bottom of cap 400 has a cap opening 430 configured to receive the top end 218 of the main body 210. The cap 400 may attach to the main body 210 in any number of ways. In some examples, the cap 400 may be configured to receive the neck 217 of the dispenser portion 214 of the main body 210. The cap 400 may be configured to be held or locked in place on the main body 210 until removed by a user. In some examples, the cap may click on to the main body 210. In other examples, the cap 400 may be screwed on and off the main body 210. In those examples, an inner side surface 437 may include screw threads (not shown) corresponding to screw threads (not shown) on the neck 217 of the main body 210. In some examples, when the neck 217 of the dispenser portion 214 is inserted into the cap 400, the outer side surfaces 439 of the cap 400 may be flush with the outside surface of the bottom part 219 of the dispenser portion 214 of the main body 210.

In other examples, the cap may attach magnetically to the main body. FIGS. 5A-5E illustrate a cap 504 that is configured to attach magnetically to the main body 510 (shown in FIG. 5E; corresponds to main body 110 and 210). In these examples, the cap 504 may include one or more receptacles or pockets 505 configured to hold magnets. The main body 510 may include one or more magnet pockets 515 corresponding to pockets 505 in the cap 504. Magnetic attraction between magnets installed in pockets 505 and 515 allow the cap 504 to be removably attached to the main body 510. However, some examples of devices including magnets may not include pockets. In these examples, magnets may be placed in or adhered to any portion of the main body and cap that allows the cap to attach magnetically to the main body. In the examples where the cap attaches magnetically to the main body, cap opening 530 does not necessarily have to have the same shape as the neck of main body 510.

While inner side surfaces 437 and 537 of respective caps 400 and 504 may be substantially circular cylindrical surfaces, they are not limited to that shape. For example, they may be elliptical cylindrical surfaces, or they may be straight surfaces. Similarly, the outer side surfaces 439 and 539 of caps 400 and 504, respectively, are shown as substantially elliptical (oval) cylindrical surfaces. However, they are not limited to this shape. The cap 400 may be any shape that allows it to cover the dispensing opening 216, and the cap 504 may be any shape that allows it to attach magnetically to main body 510.

FIGS. 6A-6D illustrate an example combination device 600 where the advancer mechanism is a slider. In these figures, the slider is installed in the combination device 600. In FIGS. 7A-7G, the slider 700 is shown in greater detail apart from the main body of the device 600. Like the previously described device 100, the device 600 includes a main body 610 having a lighter portion 612 and a dispenser portion 614. The lighter portion 612 is the same as or similar to the lighter portion 112 of the device 100, which was described above, and is therefore not repeated here.

The dispenser portion 614 of the device 600 is similar to the dispenser portion 114 of the device 100 in some respects. Each of dispenser portions 114 and 614 has a dispensing opening 116 and 616, respectively. Also, each dispenser portion is configured to hold a cosmetic product that can be advanced to protrude from the dispensing opening, and, in some examples, retracted back through the dispensing opening, as described above. However, instead of the spindle 300 described earlier, the advancing means in device 600 is a slider 700. The slider 700 is configured to advance, and, in some examples, retract, the cosmetic product 650 through the dispensing opening 616. In some examples, the dispenser portion 614 of the main body 610 has a slit 660, and the slider 700 is configured to advance the cosmetic product to protrude from the dispensing opening 616 when the slider 700 is moved along the slit 660 in the forward direction. In some examples, the slider 700 may retract the cosmetic product when the slider 700 is moved along the slit 660 in the reverse direction.

Figure 6D:
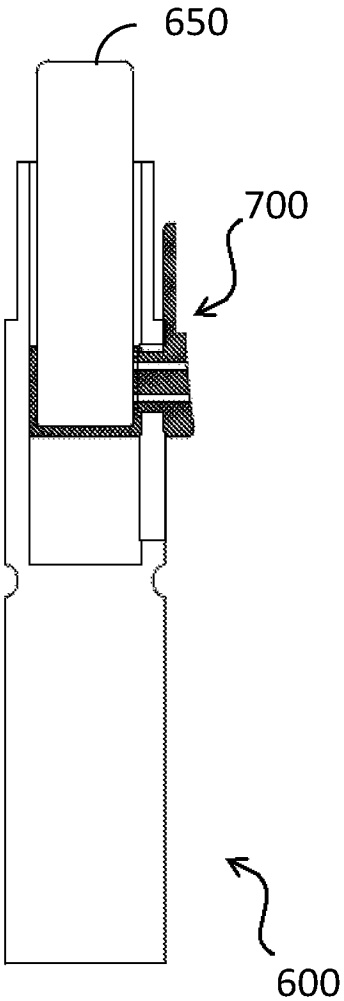
FIG. 6D is a cross-sectional view taken at line D-D in FIG. 6C.
Figure 6C:
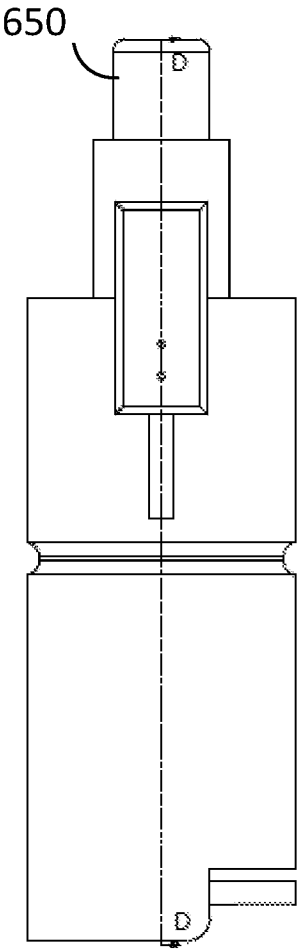
FIG. 6C is a side view of the combination device shown in FIG. 6B.
Figure 7A:
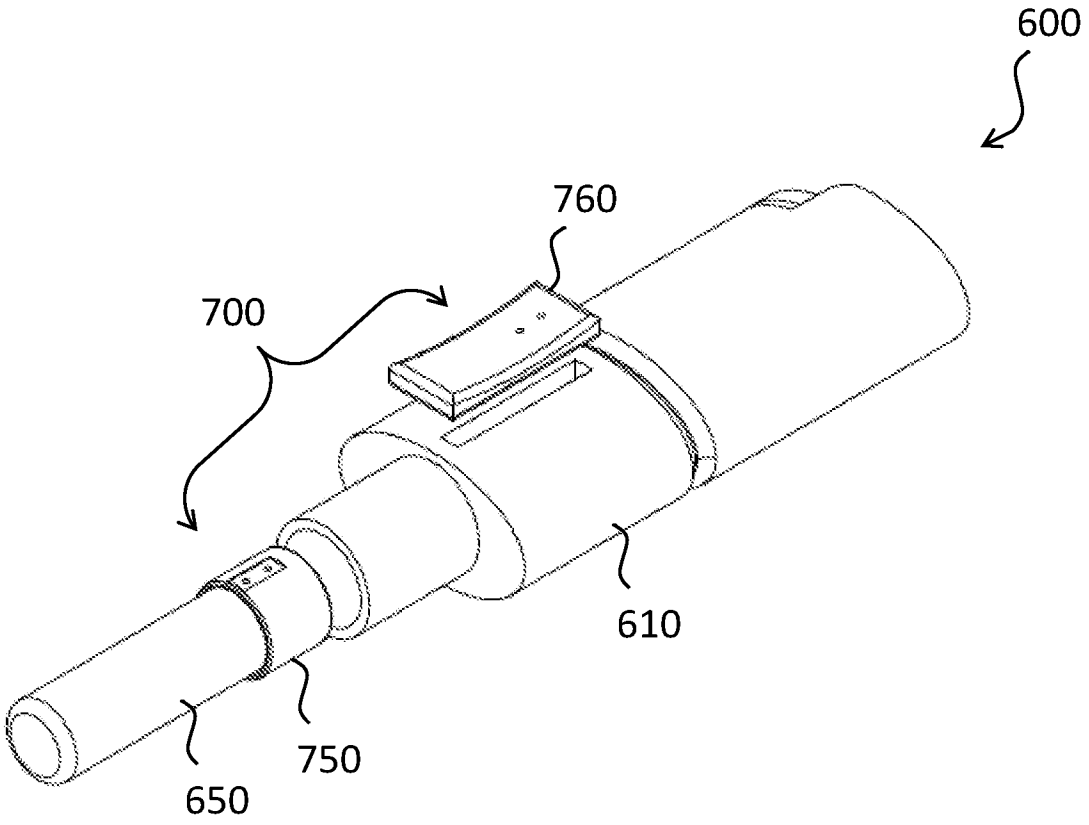
FIG. 7A is an exploded perspective view of the second embodiment of an advancer mechanism of the combination device shown in FIG. 6B.

FIG. 7A is an exploded view of the device 600 and the slider 700. In many examples, the slider 700 includes two parts: a holder 750 for the cosmetic product 650, and an actuator 760 for advancing the holder 650 together with the cosmetic product 650 such that the cosmetic product 650 protrudes from the dispensing opening 616 of the device 600. In the exploded view of FIG. 7A, the holder 750 and the actuator 760 are shown apart from the main body 610. However, when installed, the holder 750 is inside the main body 610, and the actuator 760 is attached to the holder 750, as shown in FIG. 6D. As an example, FIGS. 7B-7D show the actuator 760 having an outer portion 762 and an inner portion 764. When the slider 700 is installed in the main body 610, the outer portion 762 of the actuator 760 is outside the main body 610, and the inner portion 764 extends from the outer portion 762 through the slit 660 to the holder 750.

Figure 7E:
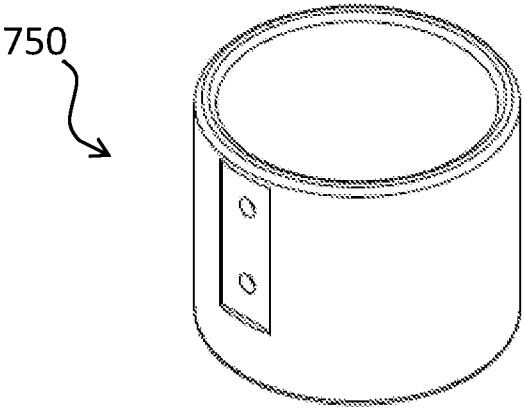
FIG. 7E is a perspective view of an example of a holder component of an advancer mechanism such as the advancer mechanism shown in FIG. 7A.
Figure 7F:
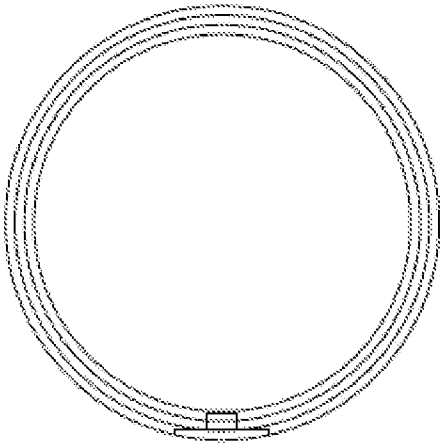
FIG. 7F is a top view of the holder shown in FIG. 7E.
Figure 7G:
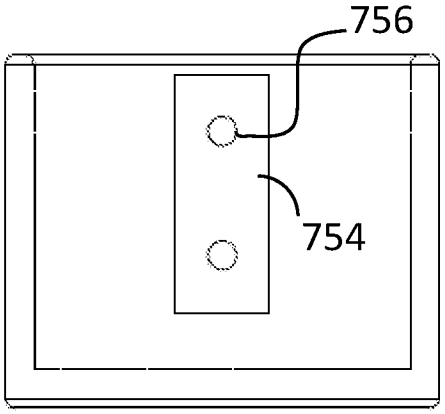
FIG. 7G is a side view of the holder shown in FIG. 7E.

FIGS. 7E-7G show the holder 750 in greater detail. In the illustrated examples, the holder 750 is shown having an indented portion 754 for receiving the inner portion 764 of the actuator. However, the holder 750 may also be manufactured without an indented portion.

The actuator 760 can be attached to the holder 750 in many different ways. In the examples illustrated in FIGS. 7A-7G, the holder 750 and the actuator 760 include hole(s) 756 and 766, respectively. In FIGS. 7E-7G, the holes 756 are located in the indented portion 754 of the holder 750. However, it is not necessary for holder 750 to include an indented portion 754, and the holes 756 may be located in a portion of the holder 750 that is not indented.

The holes 766 in the actuator 760 are illustrated in FIGS. 7B-7D. FIG. 7D shows the holes in the inner portion 764 extending all the way through the thickness of the inner portion 764 and the outer portion 762. However, in some examples (not shown), the holes 766 may not extend through the entire thickness of both the inner and outer portions 764 and 762.

Although the drawings show two holes in each part of the slider 700, this is only one example. In other examples, there can be a single hole or more than two holes in each part of the slider 700. In one example, a small screw can be inserted or tapped into each hole to attach the actuator 760 to the holder 750. In another example, a pin or peg can be inserted into each hole such that the actuator 760 clicks into place on the holder 750. In yet another example, the holes can be filled with epoxy to adhere the actuator 760 to the holder 750. Additionally or alternatively, heat can be applied to actuator 760 and the holder 750 to join them. These are just some examples of how the actuator 760 can be attached to the holder 750. However, the mode of attachment is not limited to the above-described examples.

In some examples (not shown), it is possible that the slider can be manufactured as one integral unit (one piece) instead of attaching a holder 750 to an actuator 760. In these examples, the main body 610 may be formed in such a way that it can receive a one-piece slider.

In the illustrated examples, a user can advance the cosmetic product 650 by moving the actuator 760 along a slit 660 in a forward direction towards the dispensing opening 616 such that the cosmetic product 650 increasingly protrudes from the dispensing opening 616. For example, the user can apply pressure with a thumb or other finger and slide the actuator 760 along the slit 660. In some examples, the outer surface of the outer portion 762 of the actuator 760 may be curved, as shown in FIGS. 7B and 7D, for ease of pushing the actuator 760 along the slit 660. However, in other examples, the actuator 760 may be any other shape that allows the user to move it upwards to advance the cosmetic product 650.

In some examples, the user can also retract the cosmetic product 650 by moving the actuator 760 along the slit 660 in a reverse direction towards the bottom of the dispenser portion 614. In FIGS. 7B and 7D, the outer surface of the outer portion 762 of the actuator is concavely curved, forming a gradual indentation in the outer surface of the outer portion 762. This causes the top and bottom surfaces 767 and 768 of the outer portion 762 to extend further outward (away from the inner portion 764 and the holder 750) than any points on the curved surface other than the top and bottom edges. This allows the user to easily move the slider 700 upward and downward along the slit 660 to respectively advance and retract the cosmetic product 650. However, the shape of the actuator 760 is not limited to the shape described above. It is not necessary for the actuator 760 to have a curved surface. In the examples where the cosmetic product 650 is retractable, the actuator 760 may be any shape that allows the user to move it upwards to advance or downwards to retract the cosmetic product 650.

Figure 6B:
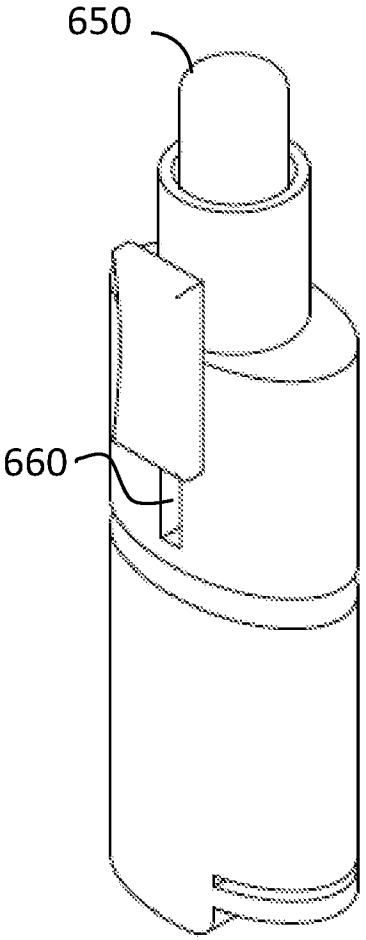
FIG. 6B is a perspective view of the second embodiment of an advancer mechanism installed in an example of a combination device, with the advancer mechanism in an advanced position.
Figure 6A:
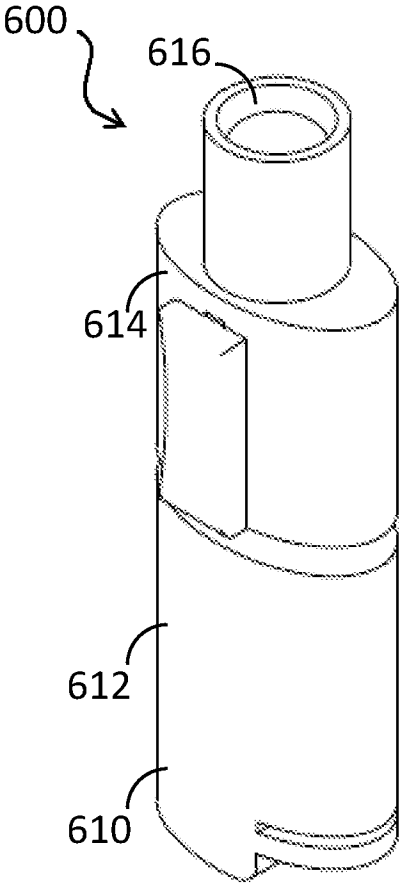
FIG. 6A is a perspective view of a second embodiment of an advancer mechanism installed in an example of a combination device, with the advancer mechanism in a retracted position.

FIG. 6A shows the device 600 where the slider 700 is in the retracted position such that the cosmetic product 650 is entirely within the main body 610. FIG. 6B shows the device 600 where the slider 700 is in an advanced position such that the cosmetic product 650 protrudes from the main body 610 via the dispensing opening 616. In the cross-sectional view of FIG. 6D, the slider 700 is shown installed in the main body 610 and assembled such that the actuator 760 is attached to the holder 750.

Figure 8B:
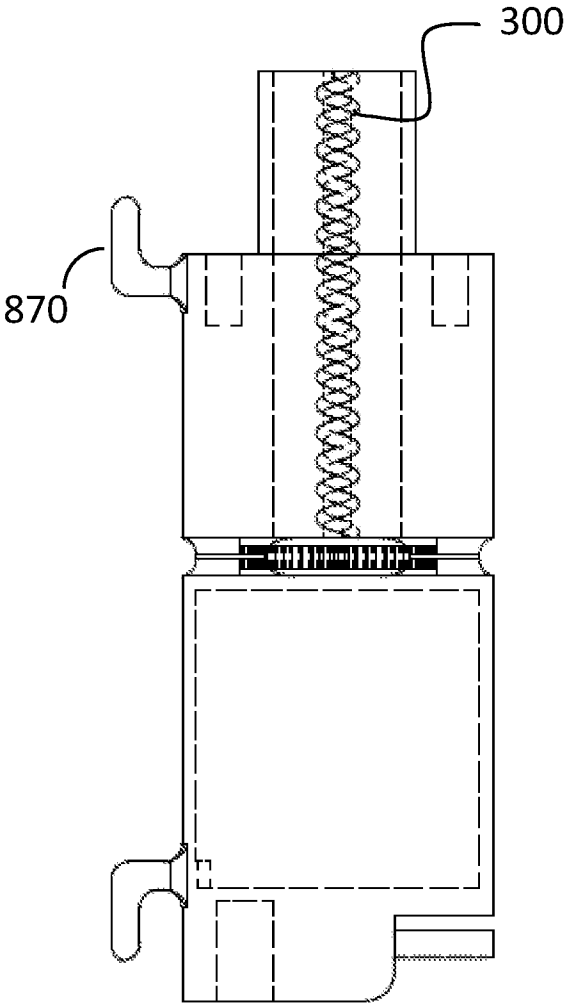
FIG. 8B is a side view of the combination device shown in FIG. 8A (not including the cap). The side view shows inner surfaces of the device and the advancer mechanism installed inside the device.
Figure 8A:
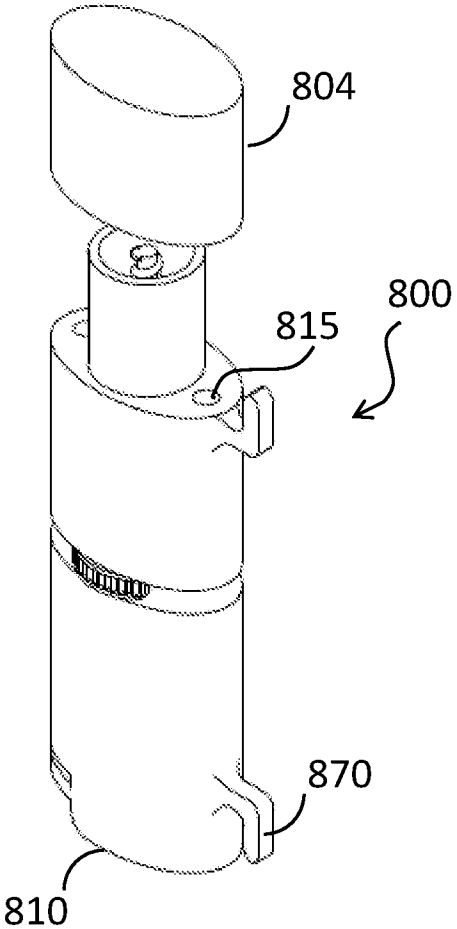
FIG. 8A is a perspective view of a first example of a combination device having protrusions for wrapping headphone wires.
Figure 8E:
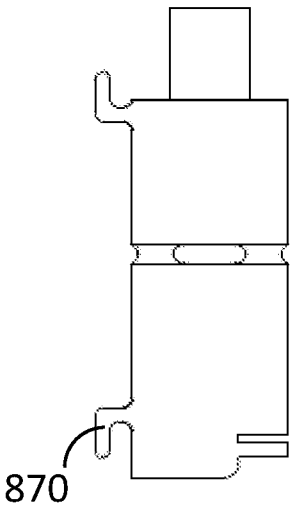
FIG. 8E is a side view of the main body shown in FIG. 8C.
Figure 8F:
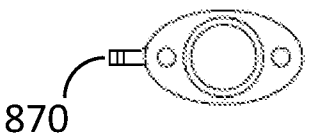
FIG. 8F is a top plan view of the main body shown in FIG. 8C.
Figure 8D:
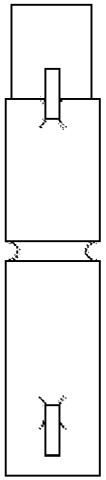
FIG. 8D is a front view of the main body shown in FIG. 8C.

FIG. 8A is a perspective view of an example of the combination device 800 having protrusions 870 for supporting or seating headphone wires. Many characteristics of device 800 are similar to those of device 100, which are described in greater detail above, and are therefore not repeated here in their entirety. In some examples, the protrusions 870 may protrude from the outer surface of main body 810. The protrusions 870 may be attached to or integral with main body 810. While protrusions 870 are shown on the front of main body 810, they may alternatively be located on the side or other part of main body 810 or device 800. Headphone wires (not shown) may be wrapped around the protrusions 870. The protrusions may be hook-like or L-shaped, but are not limited thereto. In these examples, headphone wires may be seated on the inner portion of the hook-like shape or the L-shape. In some examples, the protrusions 870 may include a rounded concave fillet, but are not limited thereto. In these examples, headphone wires may be seated within the rounded concave fillet.

In FIG. 8A, device 800 includes a cap 804 that is configured to be placed onto the main body 810 to cover the dispensing opening. However, in other examples, protrusions for headphone wires may be included on a device that does not have a cap.

FIG. 8B is a side view of the example combination device shown in FIG. 8A (not including the cap 804). The side view shows inner surfaces of the device using broken lines. For illustration purposes, it also shows the spindle 300 installed inside the device 800 as if the outer walls of the device 800 were transparent. However, device 800 may be opaque, translucent, transparent, or a combination of the above. Similarly to example device 100, a cosmetic product may be installed onto spindle 300 Also illustrated are magnet pockets 815 on the main body 810, corresponding to magnet pockets (not shown) on the cap 804. The cap 804 for device 800 may be the same as or similar to caps 400 or 504. The above descriptions regarding caps for device 100 may be applied to a cap for device 800. For example, the cap 804 may be configured to be screwed on and off main body 810, clicked on and off main body 810, or attached to main body 810 via magnetic attraction, as described in greater detail above with respect to caps 400 and 504.

Figure 8C:
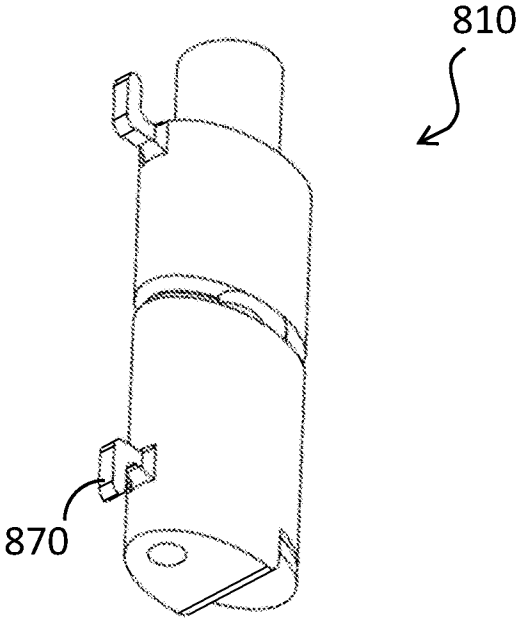
FIG. 8C is a perspective view of an example of a main body of the first example of the combination device including the protrusions for wrapping headphone wires.

FIGS. 8C-8F are different views of main body 810 of the example combination device 800. FIG. 8C is a perspective view of an example main body 810 including the protrusions 870 for wrapping headphone wires (not shown) therearound. In some examples, the headphone wires may additionally or alternatively be wrapped around the outer surface of the main body 810. While FIGS. 8A-8E show two protrusions 870, there may be only a (possibly larger) single protrusion 870 or more than two protrusions 870.

Figure 9D:
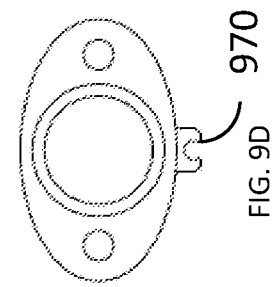
FIG. 9D is a top plan view of the main body shown in FIG. 9A.
Figure 9E:
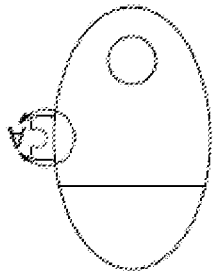
FIG. 9E is a bottom plan view of the main body shown in FIG. 9A.
Figure 9F:
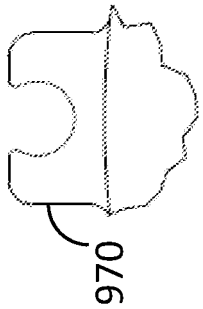
FIG. 9F is a close-up view of detail A in FIG. 9E.
Figure 9C:
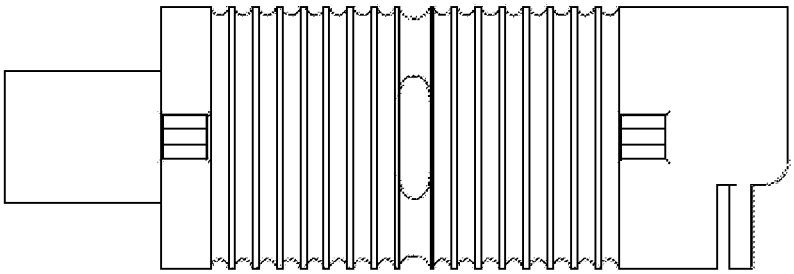
FIG. 9C is a side view of the main body shown in FIG. 9A.
Figure 9B:
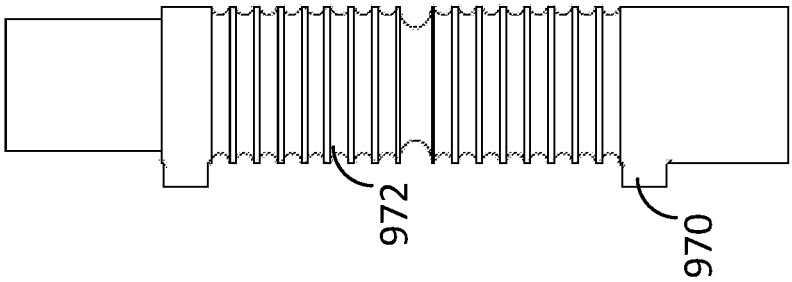
FIG. 9B is a front view of the main body shown in FIG. 9A.
Figure 9A:
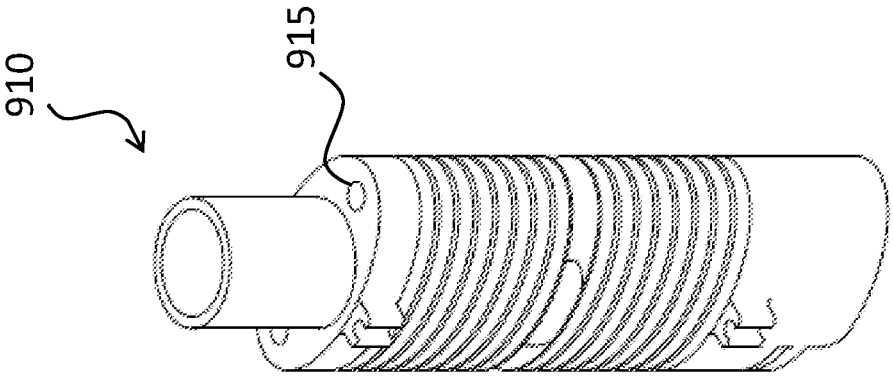
FIG. 9A is a perspective view of a main body of a second example of a combination device including protrusions for wrapping headphone wires.

FIGS. 9A-9F illustrate the main body 910 of another example device having protrusions 970 for headphone wires. The protrusions 970 may protrude from main body 910. While FIGS. 9A-9C show two protrusions 970, there may be only a single protrusion 970 or more than two protrusions 970. In some examples, protrusions 970 may be U-shaped or C-shaped, but are not limited thereto. FIG. 9F is a close-up view of detail A in FIG. 9E, showing an example protrusion 970 with straight outer sides and a C-shaped inner surface for seating a headphone wire. However, the shape of protrusions 970 is not limited thereto. The protrusions 970 may support or seat headphone wires (not shown). The headphone wires may be secured within protrusions 970. Although shown on a side surface of main body 910, protrusions 970 can be on the front or side or other part of the main body 910. In some examples, the headphone wires may be wrapped around the outer surface of the main body 910. In some examples, the outer surface of the main body 910 may include one or more grooves 972 for seating headphone wires that are wrapped around the outer surface of the main body 910. The groove(s) 972 may encircle the main body 910. The groove(s) 972 may be annular or spiral-shaped but are not limited thereto. In an example, a groove 972 can be in a spiral shape encircling all or most of the main body 910 between two protrusions 970. In this and other examples, the headphone wire can be wrapped around main body 910 while seated in the groove 972 and secured by being seated in the protrusions 970.

Other aspects of main body 910 are similar to aspects described above with respect to the other example devices. For example, main body 910 has pockets 915 for magnets in order to form a magnetic closure with a cap such as cap 504 described earlier.

Figure 10B:
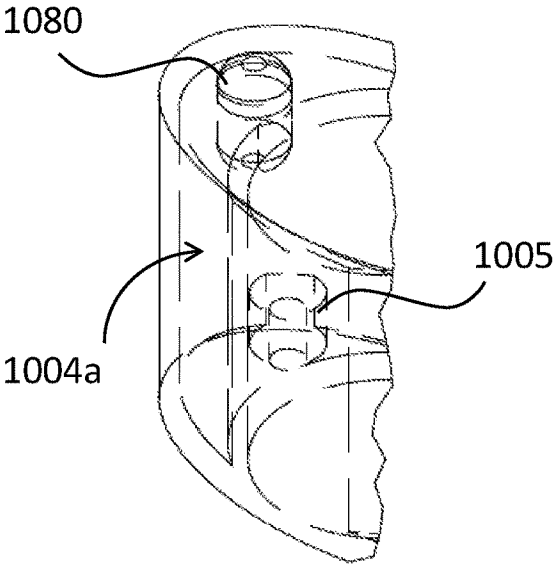
FIG. 10B is a close-up view of detail A in FIG. 10A.
Figure 10A:
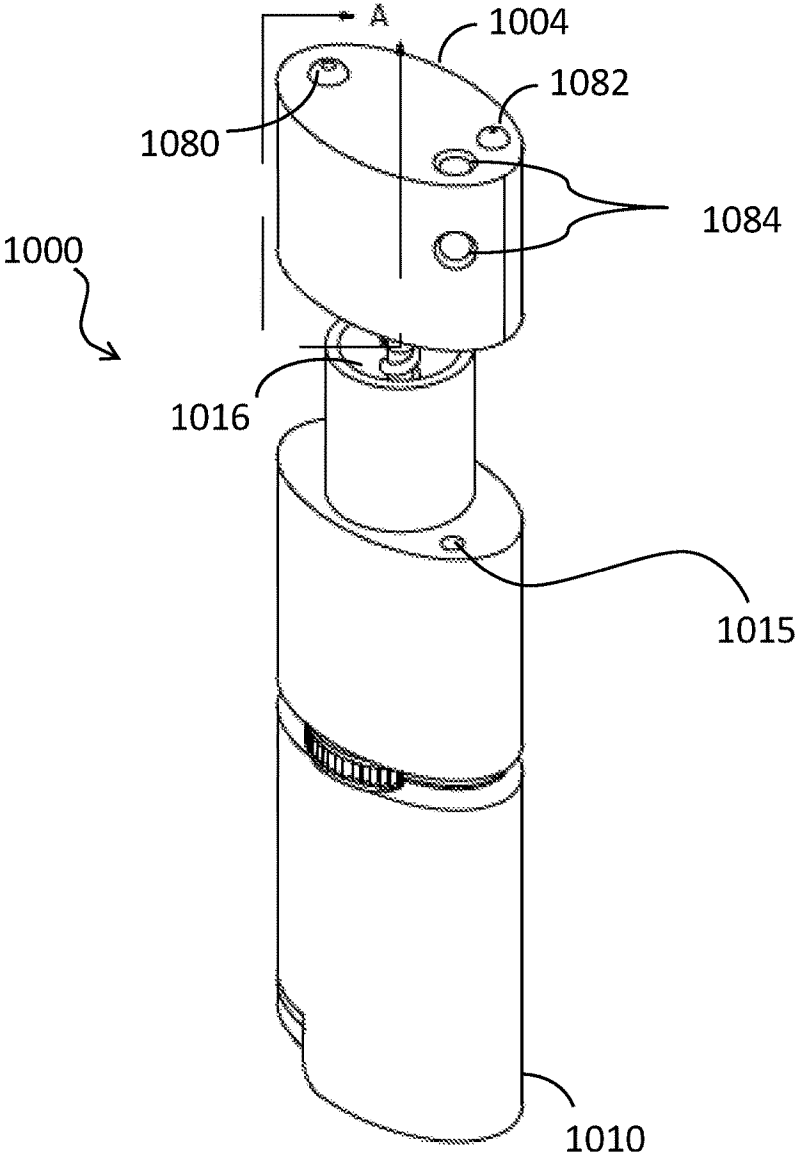
FIG. 10A is a perspective view of an example of a combination device including a flashlight on the cap.
Figure 11B:
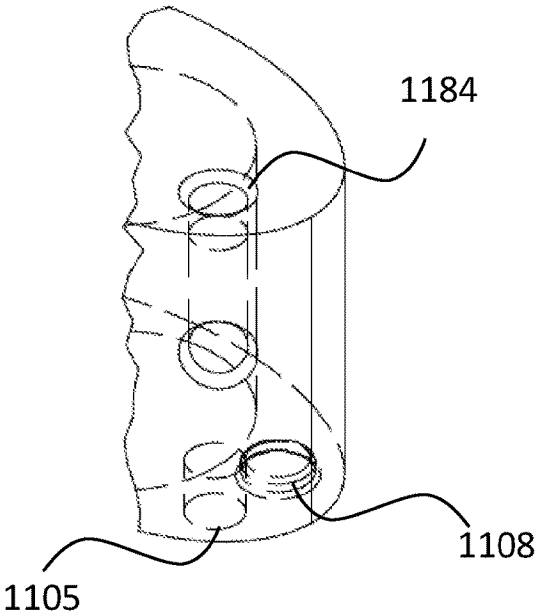
FIG. 11B is a close-up view of detail A in FIG. 11A.
Figure 11A:
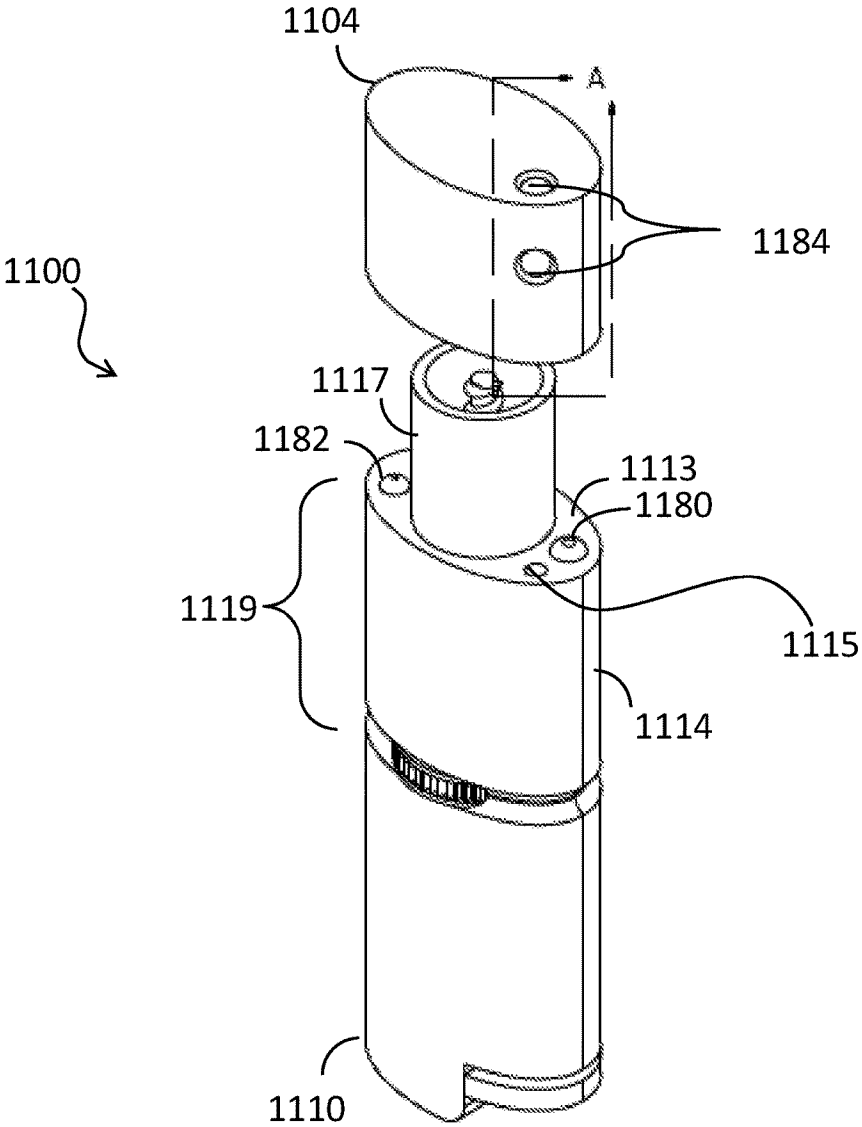
FIG. 11A is a perspective view of an example of a combination device including a flashlight on the main body.

FIGS. 10A and 11A are perspective views of example combination devices that, in addition to many of the functions described above, function as a flashlight. Each of these devices includes a light-emitting component such as an LED (light emitting diode). In the descriptions that follow, for the sake of brevity and clarity, the term LED will be used to refer to the light-emitting component in each of the devices. However, the light-emitting component is not limited to an LED. Any other light-emitting element, such as a small incandescent or fluorescent light bulb, may be used instead of an LED, and the descriptions below regarding an LED can be applied to other light-emitting elements. The light-emitting component is one example of a flashlight component. Another flashlight component that may (but not necessarily) be included is an ON/OFF switch. Other flashlight components may also be included.

FIG. 10A shows an example combination device 1000 that has an LED 1080 on the cap 1004 of the device 1000. Similarly to other examples described above, the cap 1004 is configured to be attached to the main body 1010 using magnetic attraction. FIG. 10B shows that cap 1004 has pocket(s) 1005 configured to hold magnets (while only one pocket 1005 is shown in the partial view of the cap 1004, the cap 1004 may also have a pocket in the portion of the cap that is not shown in FIG. 10B). The illustrated main body 1010 of device 1000 has pockets 1015 for magnets (only one pocket 1015 is shown in FIG. 10A due to the angle of the perspective view, but the main body 1010 can also have another pocket that is not shown). However, some examples of devices including magnets may not include pockets. In these examples, magnets may be placed in or adhered to any portion of the main body and cap that allows the cap to attach magnetically to the main body.

Any of the example devices described above can include the LED and other flashlight components described with respect to device 1000. For example, devices having caps that screw on or click on, devices having protrusions and/or grooves for headphone wires, and devices having a slider as the advancing means (instead of the spindle shown in device 1000) can all be manufactured with flashlight components in addition to their other features.

Some examples of the device 1000 may include a hole 1084 in the cap 1004 for attaching a key ring, key chain, lanyard, or other string/necklace/bracelet/rope that will allow the device to be worn by the user and/or prevent the device getting lost. While the hole 1084 can be used for any of the above purposes or uses (or for other purposes/uses not mentioned), the descriptions that follow will use the term "key chain hole" or "key ring hole" or simply "hole 1084" for the sake of brevity and clarity. In the illustrated version of the device 1000, the hole 1084 is located in one corner of the cap 1004. However, the hole 1084 can be located anywhere on the cap 1084 that does not prevent the cap from closing properly and/or interfere with the functioning of the flashlight components. Moreover, while the depicted hole 1084 has one opening on the top of the cap 1004 and another opening on a side of the cap 1004, the locations of the two openings is are not limited to those shown (for example, both openings can be on the top of the cap, or both openings can be on (a) side(s) of the cap). Although the hole 1084 is shown on device 1000 having an LED 1080, any of the above-described devices can include a hole 1084 in the cap, even if they do not include any flashlight components.

In the example shown in FIG. 10A, in device 1000, the LED 1080 is located on top of the cap 1004 across from the hole 1084. However, the LED 1080 may be located at another location on the cap. The cap 1004 may also include an ON/OFF switch or button 1082 for turning on and off the LED 1080. In FIG. 10A, the ON/OFF button 1082 is shown on the top of the cap 1004 near the key chain hole 1084. However, the ON/OFF button 1084 may be located at another location on the cap. For example, the ON/OFF button 1082 may be located closer to the LED 1080. FIG. 10B shows a hollow portion or space 1004*a* in the cap 1004 below the LED 1080. This space 1004*a* may contain a battery and/or circuitry (not shown) that leads to the circuitry connected to the ON/OFF button 1082 forming an electrical connection between the ON/OFF button 1082 and the LED 1080. The battery (not shown) for the LED 1080 may be located anywhere inside the cap 1004 that does not obstruct or negatively interfere with the closure of the cap over the dispensing opening 1016 of the device 1000.

FIG. 11A shows another version of a device that can function as a flashlight. Device 1100 includes an LED 1180 on the main body 1110. In the illustrated example, the LED 1180 is located on the "shoulder" surface 1113 of the main body 1110. The shoulder 1113 is the top surface of the "wide" portion 1119 ("wide" meaning wider than the neck 1117) of the dispenser portion 1114 of the main body 1110. However, in other examples, the LED 1180 may be located anywhere on the main body 1110 that does not obstruct or negatively interfere with functions of the device 1110 (such as cap closure, lighter, and dispensing the cosmetic product). In the example shown in FIG. 11A, the LED 1180 is located on one side of the shoulder 1113, and an ON/OFF button 1182 is located on the other side of the shoulder 1113. However, in other examples, the ON/OFF button 1182 may be located on the same side of the shoulder 1113 as the LED 1180. In other examples, the ON/OFF button 1182 may be located anywhere on the main body 1110 that does not obstruct or negatively interfere with functions of the device 1110. Circuitry (not shown) connecting the LED 1180 to the ON/OFF button 1182 and to a battery (not shown) may be located anywhere in the main body that does not obstruct or negatively interfere with functions of the device 1110. For example, the circuitry may be located directly under the LED 1180 and may extend across the main body 1110 to connect to the ON/OFF button 1182. In some examples, the ON/OFF button 1182 may be located directly above the circuitry. The circuitry may also connect to a battery (not shown), which may be located in the main body 1110 below the shoulder 1113. In the example shown in FIG. 11A, the battery and circuitry (not shown) may be located in the main body 1110 below the magnet pockets 1115. To operate the flashlight function of the device 1100, a user can remove the cap 1104 and press the button 1182 to activate the LED 1180 on the main body 1110.

FIG. 11B shows a partial view of the cap 1104 of the device 1100 shown in FIG. 11A. While FIG. 11A shows the outer surfaces of the device 1100 and the cap 1104, FIG. 11B also shows some of the inner portions of the cap 1104. As shown, the cap 1104 may include a key ring hole 1184. However, other examples, the cap 1104 may be formed without a key ring hole. The cap 1104 may also include magnet pockets 1105 for creating a magnetic attachment with magnets in pockets 1115 on the main body 1110. In other examples, the cap 1104 and the main body 1110 may be formed without magnet pockets. The cap 1104 may also include a pocket 1108 for receiving the top of the LED 1180 so that the LED 1180 on the main body 1110 does not interfere with the closure of the cap on the main body. The cap 1104 may also include a similar pocket (not shown) for receiving the top of the ON/OFF button 1182 so that the ON/OFF button 1182 on the main body 1110 does not interfere with the closure of the cap on the main body.

Figure 12C:
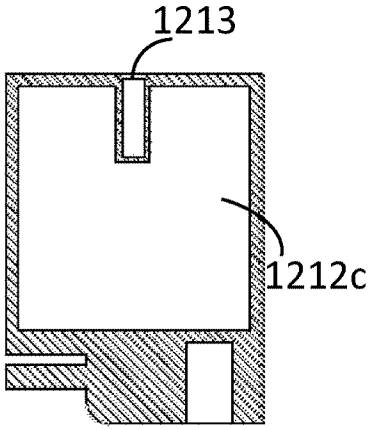
FIG. 12C is a cross-sectional view taken at line B-B in FIG. 12B.
Figure 12B:
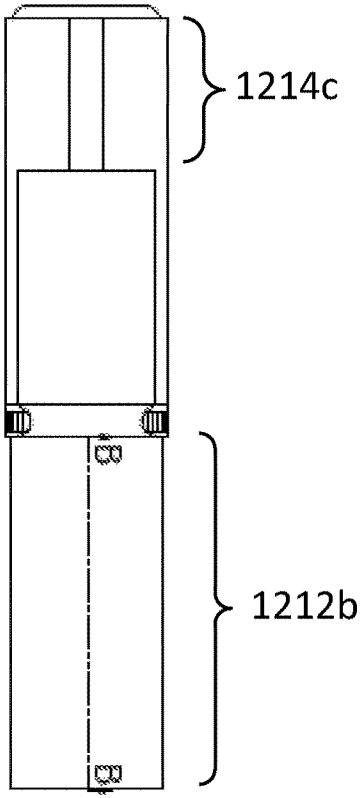
FIG. 12B is a front view of the device shown in FIG. 12A (not including the cap).
Figure 12A:
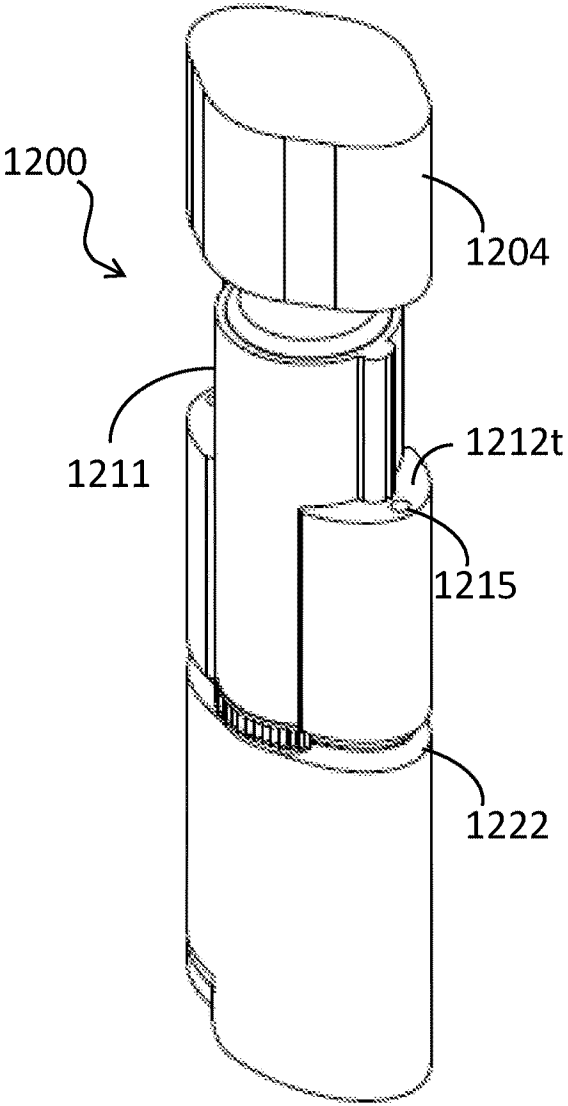
FIG. 12A is a perspective view of an example of a refillable combination device having a lighter body and a dispenser body that is removable from the lighter body. The example shown also includes a cap.

FIGS. 12A-12J illustrate an example combination device 1200 that is refillable. FIG. 12A is a perspective view of the example refillable combination device 1200 having a dispenser sub-assembly 1211, which includes a dispenser body 1214, removably coupled to a lighter body 1212. The dispenser sub-assembly 1211 is coupled to the lighter body 1212 such that it is fastened to the lighter body firmly enough that it will not easily fall out accidentally but can be easily removed from the lighter body 1212 by or for a user of the device 1200.

The lighter body 1212 is configured to house lighter fluid and a lighter mechanism capable of lighting a flame. The lighter body 1212 has an upper portion configured to at least partially surround the dispenser sub-assembly 1211. The upper portion 1212*a* may be composed of two or more extensions or wings 1212*a* that extend upward from a lower portion 1212*b* of the lighter body 1212, as shown the illustrated example. However, in other examples (not shown), the upper portion may extend completely or almost completely around the outer circumference of the dispenser sub-assembly 1211. The lower portion 1212*b* of the lighter body 1212 is configured to contain (house) lighter fluid within an inner space 1212*c*. When the dispenser sub-assembly 1211 is removed from the lighter body 1212, the lighter fluid can be refilled via a valve 1213 configured to allow lighter fluid to enter the lighter body 1212. In some examples, the valve 1213 may be installed in an upper surface 1212*d* of the lower portion 1212*b* of the lighter body 1212.

In some examples, when installed in the lighter body 1212, the dispenser sub-assembly 1211 is configured to rest upon the upper surface 1212*d* of the lower portion 1212*b* of the lighter body 1212, and the wings 1212*a* of the lighter body 1212 at least partially encircle the dispenser sub-assembly 1211, as shown in FIG. 12A.

In some examples, the device 1200 further includes a means for releasably latching the dispenser body 1214 to the lighter body 1212. For example, the dispenser sub-assembly 1211 may be installed in the lighter body 1212 by being clicked into place (snap-in or snap fit). In this example, the user can gently squeeze the sides of the dispenser body 1214 when placing the dispenser sub-assembly 1211 into the lighter body 1212. In some versions, the flanges 1214*a* or other portions of the outer surface of dispenser body 1214*b* may include additional protrusions (not shown) that fit into corresponding mating grooves (not shown) in the grooves 1212*e* or other portions of the inner surfaces of the upper portion 1212*a* of the lighter body 1212. The user can pull out the dispenser sub-assembly 1211 from the lighter body 1212 in order to refill the lighter fluid or install a different dispenser sub-assembly 1211 or replace the cosmetic product 1250. The versions including additional protrusions and corresponding mating grooves may require greater force to pull out the dispenser sub-assembly 1211 than versions without these features. In some versions, the user may be able to squeeze in the sides of the dispenser body 1214 when removing the dispenser sub-assembly 1211.

The means for releasably latching the dispenser body 1214 to the lighter body 1212 is not limited to the above example. In another example, the dispenser sub-assembly 1211 may be screwed into and out of the lighter body 1212. In this example, the outer surface 1214*b* of the dispenser body 1214 and the inner surface of the upper portion 1212*a* of the lighter body 1212 may have corresponding screw threads (not shown) instead or in addition to the flanges 1214*a* and the grooves 1212*e*, respectively. The dispenser sub-assembly 1211 may be latched to the lighter body 1212 by any other features that allow the dispenser sub-assembly 1211 to be attached securely to and also easily released from the lighter body 1212.

Alternatively or additionally, the dispenser sub-assembly may be attached magnetically to the lighter body 1212 in some examples. In some of these examples, the lighter body 1212 may have one or more pockets (not shown) to receive (hold) one or more (first) magnets. In some of these examples, the dispenser body 1214 also has one or more pockets (not shown) to receive (hold) one or more (second) magnets. In these examples, the dispenser body 1214 is secured (coupled) to the lighter body at least by a magnetic attraction between the (first) magnet(s) seated in the pocket (s) in the lighter body 1212 and the (second) magnet(s) in the pocket(s) in the dispenser body 1214. For example, there may be magnets (not shown) installed in or on the upper surface 1212*d* of the lower portion 1212*b* of the lighter body 1212 that can be attracted to magnets (not shown) on a bottom surface of the dispenser body 1214 or other portion the dispenser sub-assembly 1211. The magnetic attraction allows the dispenser body 1214 to be removably coupled to the lighter body 1212. Some examples of devices including magnetic attraction may not include pockets for any or all of the magnets. In these examples, magnets may be placed in or adhered to any portions of the dispenser sub-assembly and lighter body that allow the dispenser sub-assembly to attach magnetically to the lighter body. While magnetic attraction allows for a secure coupling, a user can easily remove the dispenser sub-assembly 1211 from the lighter body 1212.

Alternatively or additionally, the dispenser sub-assembly 1211 may be held in place in the lighter body 1212 by friction. In these examples, the surfaces of the dispenser sub-assembly 1211 and the lighter body 1212 may be modified or formed from a material that allows for a secure friction fit.

Figure 12D:
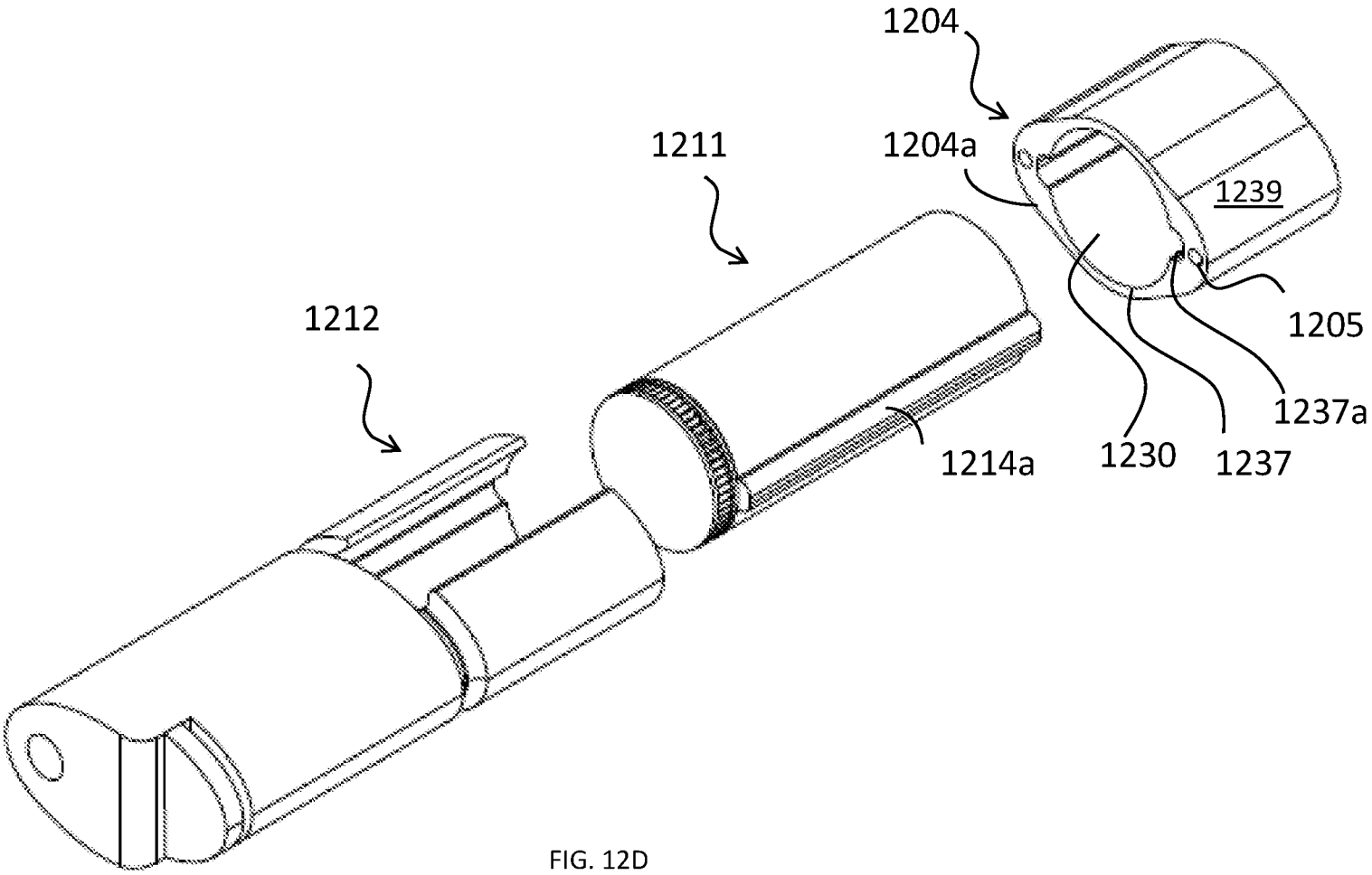
FIG. 12D is an exploded perspective view of the device shown in FIG. 12A.
Figure 12E:
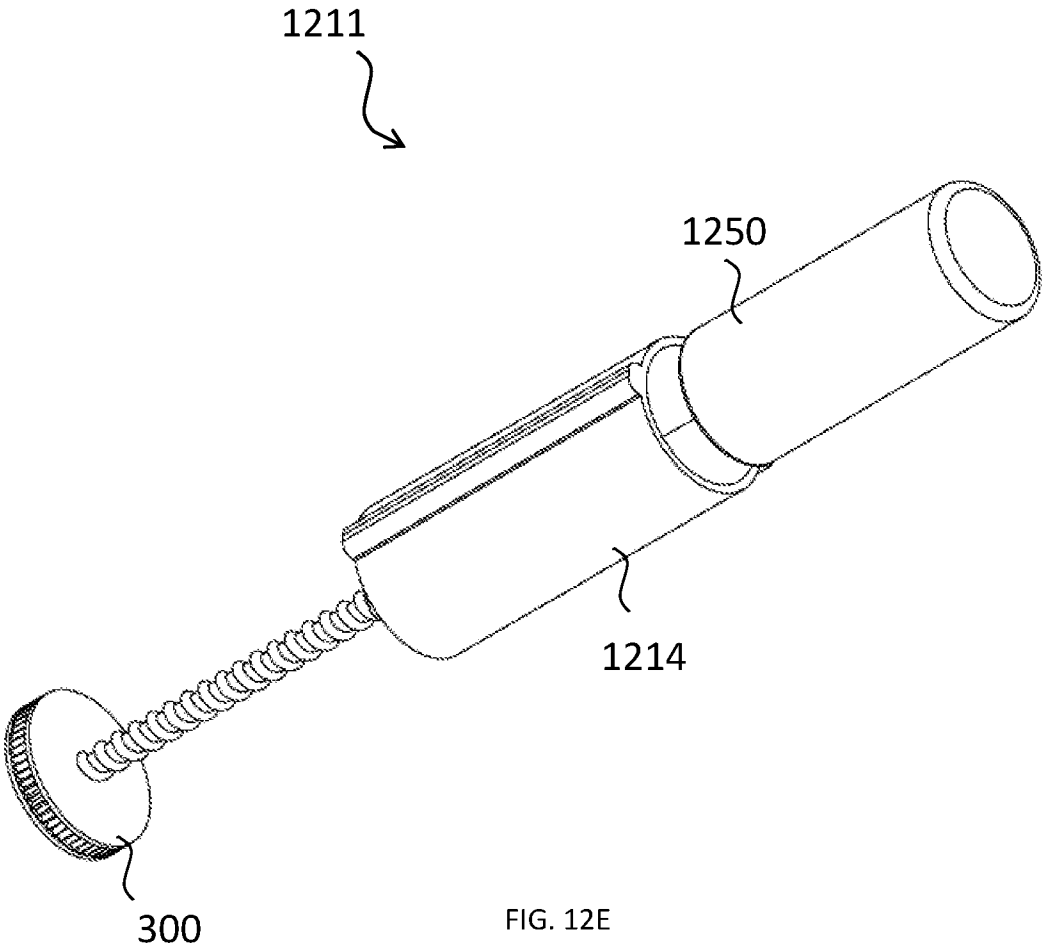
FIG. 12E is an exploded perspective view of the dispenser sub-assembly of the device shown in FIG. 12D.

FIG. 12D is an exploded perspective view of the device 1200, where the dispenser sub-assembly 1211 is separated from the lighter body 1212. FIG. 12E is an exploded perspective view of the dispenser sub-assembly 1211 of the device shown in FIG. 12D. The dispenser sub-assembly 1211 includes a dispenser body 1214 and a cosmetic product 1250 configured to be housed in the dispenser body 1214. The dispenser body 1214 may have a dispensing opening 1216. In the illustrated example, the dispenser sub-assembly 1211 also includes a spindle 300 as an advancer mechanism. The spindle 300 functions to advance and/or retract the cosmetic product 1250 through the dispensing opening 1216 as described above with respect to example device 100. In other examples, the dispenser sub-assembly 1211 may include a slider instead of a spindle, and the dispenser body 1214 may be configured to include the slider such as is described above with respect to example device 600. Alternatively, the dispenser sub-assembly 1211 may include any other type of advancer mechanism capable of advancing the cosmetic product 1250 to protrude from the dispensing opening 1216 when activated by a user when the dispenser sub-assembly 1211 is coupled to the lighter body 1212.

In examples where the advancer mechanism includes the spindle 300, when the dispenser sub-assembly 1211 is assembled, the rotation head 320 of the spindle 300 may be at the bottom end of the dispenser body 1214, and the shaft 340 of the spindle 300 may extend inside the dispenser body 1214 from the rotation head 320 towards the dispensing opening 1216. The rotation head 320 can be turned (rotated) to advance the cosmetic product 1250 to protrude from the dispensing opening 1216.

Figure 12G:
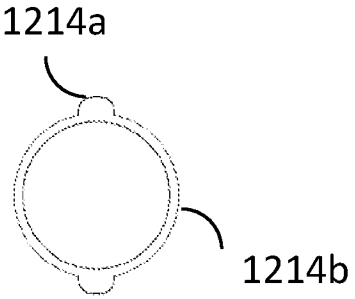
FIG. 12G is a top plan view of the dispenser body shown in FIG. 12F.
Figure 12F:
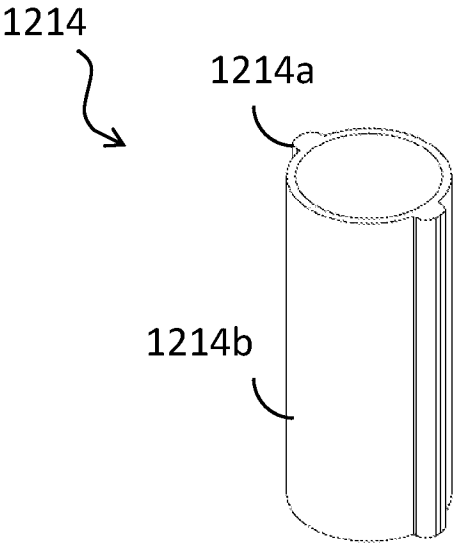
FIG. 12F is a perspective view of the dispenser body of the dispenser sub-assembly shown in FIG. 12E.

FIGS. 12F and 12G illustrate the dispenser body 1214 that is part of the dispenser sub-assembly shown in FIG. 12E. In the illustrated example, flanges 1214*a* protrude from the outer surface 1214*b* of the dispenser body 1214.

Figure 12J:
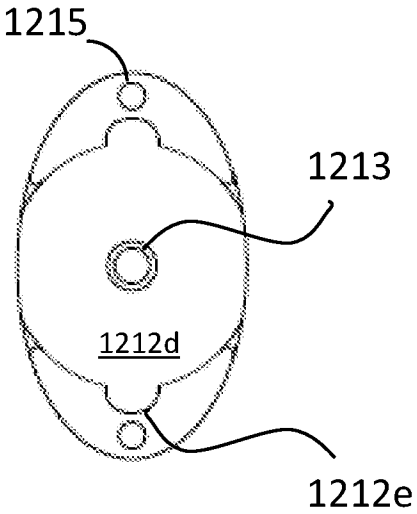
FIG. 12J is a top plan view of the lighter body shown in FIG. 12H.
Figure 12H:
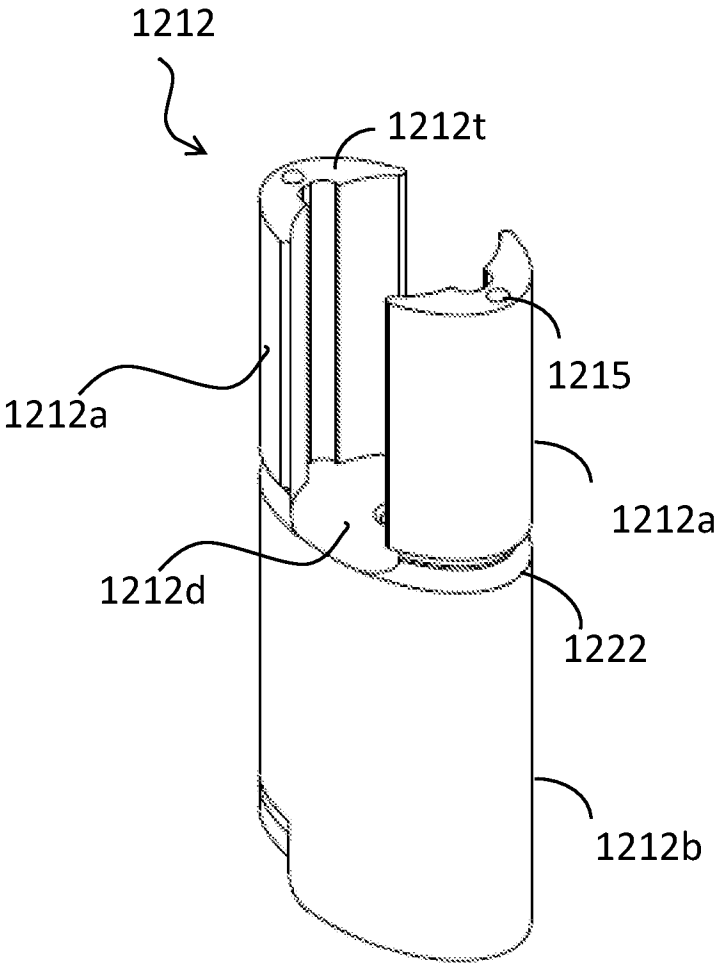
FIG. 12H is a perspective view of the lighter body of the example of the device shown in FIG. 12D.
Figure 13C:
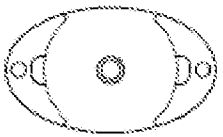
FIG. 13C is a top plan view of the lighter body shown in FIG. 13A.
Figure 13D:
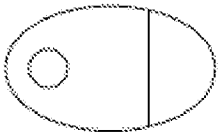
FIG. 13D is a bottom plan view of the lighter body shown in FIG. 13A.
Figure 13B:
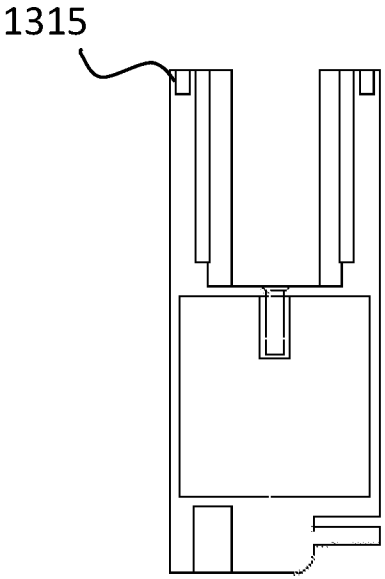
FIG. 13B is a side view of the lighter body shown in FIG. 13A.
Figure 13A:
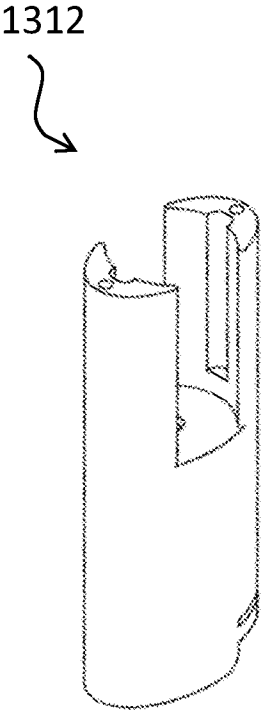
FIG. 13A is a perspective view of another example of a lighter body of a refillable combination device.

FIGS. 12H and 12J illustrate the lighter body 1212 shown in FIG. 12D. The top-plan view in FIG. 12J is enlarged for ease of viewing the detailed features of the lighter body 1212. The inner surfaces of the wings 1212*a* have grooves 1212*e* for receiving flanges 1214*a* of the dispenser body 1214 when the dispenser sub-assembly 1211 is coupled to the lighter body 1212. To couple the dispenser sub-assembly 1211 to the lighter body 1212, the dispenser sub-assembly 1211 is inserted into the lighter body 1212 with the flanges 1214*a* inserted into the grooves 1212*e*, and the dispenser sub-assembly 1211 can slide until it rests upon surface 1212*d* of the lighter body 1212. As described above, in some examples, the dispenser sub-assembly 1211 can be clicked into, screwed into, or gripped in place with or without the use of magnets (not shown). In some examples, when the dispenser sub-assembly 1211 is coupled to the lighter body 1212, an upper portion 1214*c* of the dispenser body 1214 extends above lighter body 1212.

FIGS. 12A and 12D also show a removable cap 1204 configured to cover the dispensing opening 1216 of the refillable device 1200. The cap 1204 has an opening 1230 configured to receive the upper portion 1214*c* of the dispenser body 1214 that extends above lighter body 1212 when the dispenser sub-assembly 1211 is coupled to the lighter body 1212 (as illustrated in FIGS. 12A and 12B). In some examples, as illustrated in FIG. 12D, the inner side surface 1237 of the opening 1230 may include grooves 1237*a* for receiving the flanges 1214*a* of the dispensing body 1214. In some examples, when the upper portion 1214*c* of the dispenser body 1214 is fully inserted into the cap 1204, the outer side surfaces 1239 of the cap 1204 may be flush with the outside surfaces of the wings 1212*a* of the lighter body 1212.

When the cap 1204 covers the dispensing opening 1216 (for example, when the upper portion 1214*c* of the dispenser body 1214 is fully inserted into the cap 1204), a bottom surface 1204*a* of the cap 1204 is configured to be in contact with a top surface 1212*t* of the lighter body 1212. In this way, the cap 1204 may be configured to help secure the dispenser sub-assembly 2111 to the lighter body 1212.

In a similar fashion as cap 504 described above, in some examples, the cap 1204 of device 1200 may include one or more pockets 1205 configured to hold one or more magnets. In these examples, the lighter body 1212 also has one or more pockets 1215 configured to hold (receive) one or more magnets. When the cap 1204 is installed on the device 1200, magnets in pockets 1205 in the cap 1204 may attract to magnets in corresponding pockets 1215 in the lighter body 1212, thereby forming a magnetic closure of the cap 1204 onto the device 1200. The magnetic attraction can serve to secure the cap 1204 to the device 1200. The magnetic attraction between the cap 1204 and the lighter body 1212 can also serve to secure the coupling of the dispenser sub-assembly 1211 to the lighter body 1212, in addition to or instead of other means of coupling the dispenser sub-assembly 1211 to the lighter body 1212 described above. As discussed earlier, some examples of devices including magnets may not include pockets. In these examples, magnets may be placed in or adhered to any portions of the lighter body, dispenser sub-assembly, and cap that allow the cap and/or the dispenser sub-assembly to attach magnetically to the lighter body.

In some examples, in addition to or instead of a magnetic closure, the cap 1204 may be secured to the device 1200 by a screw-type closure, or by a friction fit. For the screw-type closure, there may be corresponding threads on the inner surface 1237 of the cap 1204 and the outer surface of the upper portion 1214*c* of the dispenser body 1214. In some examples having a screw-type closure, grooves 1237*a* may be modified or excluded from the cap 1204, and flanges 1214*a* may be modified or excluded from the upper portion 1214*c* of the dispenser body 1214.

In some examples, the cap 1204 may include a key chain hole similar to keychain hole 1084 described above. In some examples, the cap 1204 may additionally or alternatively include flashlight components such as LED 1080 and/or ON/OFF button 1082 as described above.

FIGS. 13A-13D illustrate another example of a lighter body for a refillable combination device. While FIG. 12H shows the lighter body 1212 having a groove 1222 at the bottom of the wings 1212*a*, this groove 1222 is not necessary for proper functioning of the device 1200 and may not necessarily be present in other examples of the device 1200. FIGS. 13A-13D illustrate a lighter body 1312 that is similar to lighter body 1212 except that it does not have the groove 1222.

Figure 14B:
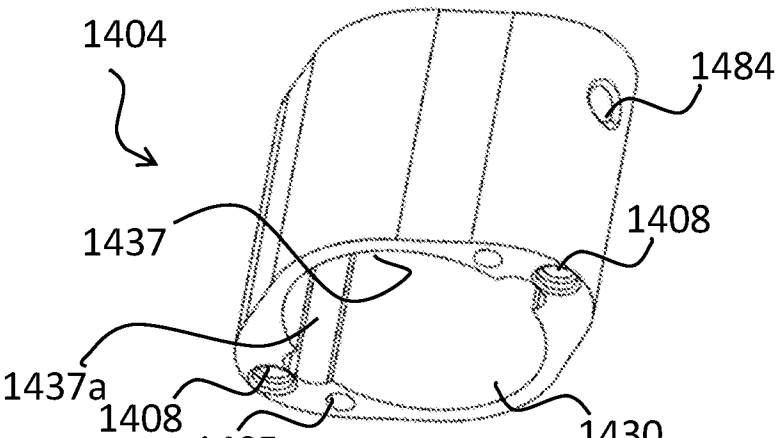
FIG. 14B is a perspective view of an example of a cap of the device shown in FIG. 14A.
Figure 14C:
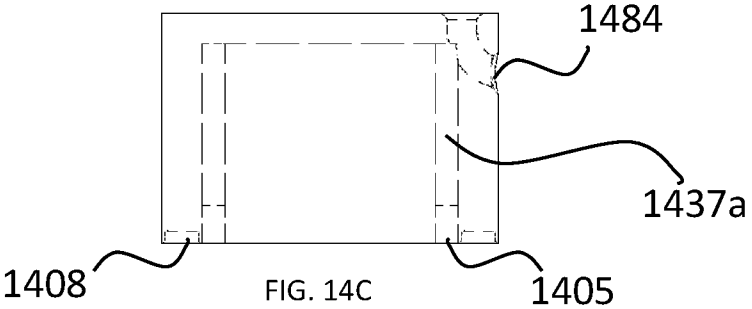
FIG. 14C is a side view of the cap shown in FIG. 14B.
Figure 14A:
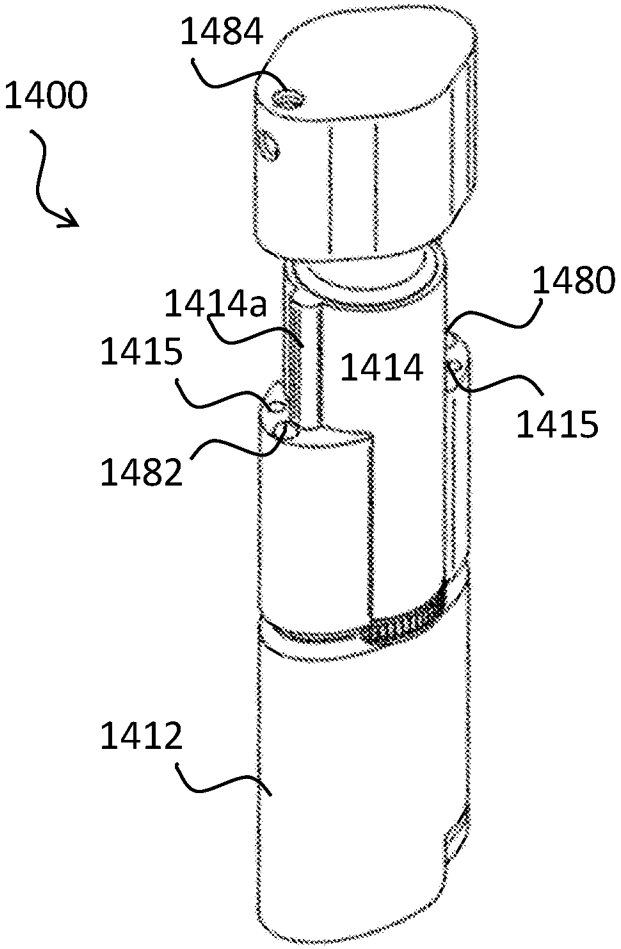
FIG. 14A is a perspective view of another example of a refillable combination device.

FIG. 14A is a perspective view of another example of a refillable combination device. Refillable combination device 1400 includes light-emitting component 1480 and other flashlight components such as ON/OFF button 1482. In some examples the cap 1404 for device 1400 includes a key chain hole 1484, similar to examples described above. FIGS. 14B and 14C are detailed views of the cap 1404. The cap 1404 may include pockets 1408 for receiving the tops of LED 1480 and ON/OFF button 1482. The cap 1404 may also include pockets 1405 for magnets corresponding to pockets 1415 for magnets on the top surface of the lighter body 1412. Similar to cap 1204 and device 1200 described above, inner side surfaces 1437 of the opening 1430 may include grooves 1437*a* for receiving the flanges 1414*a* of the dispensing body 1414. Other aspects of device 1400 and cap 1404 are similar to aspects described above.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings. The foregoing description and drawings are accordingly to be regarded in an illustrative rather than restrictive sense.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus the following claims are hereby incorporated into the Detailed Description, with each claim standing on its own as a separately claimed subject matter.

What is claimed is:

1. A device comprising:

a lighter body configured to house lighter fluid and a lighter mechanism capable of lighting a flame, the lighter body comprising a valve configured to allow lighter fluid to enter the lighter body;

a dispenser body removably coupled to the lighter body, the dispenser body having a dispensing opening and configured to house a cosmetic product;

an advancer mechanism configured to advance the cosmetic product to protrude from the dispensing opening; and a removable cap configured to cover the dispensing opening, wherein a bottom surface of the cap is configured to be in contact with a top surface of the lighter body when the cap covers the dispensing opening.

2. The device of claim 1, wherein the advancer mechanism includes a spindle having a rotation head and a shaft protruding from the rotation head, the rotation head is at a bottom end of the dispenser body, and the shaft extends inside the dispenser body from the rotation head towards the dispensing opening, and the rotation head is configured to be turned to advance the cosmetic product to protrude from the dispensing opening.

3. The device of claim 1, further comprising a means for releasably latching the dispenser body to the lighter body.

4. The device of claim 1, wherein the lighter body further comprises a groove on a surface and encircling the lighter body, the groove configured to seat the headphone wire.

5. The device of claim 1, further comprising:

a first magnet, and a second magnet;

wherein the lighter body has a pocket receiving the first magnet, the dispenser body has a pocket receiving the second magnet, and the dispenser body is removably coupled to the lighter body at least by a magnetic attraction between the first and second magnets.

6. A device comprising:

a lighter body with an upper portion and a lower portion, wherein the lower portion includes a lighter mechanism capable of lighting a flame;

a dispenser subassembly comprising a dispenser body and an advancer mechanism, the dispenser body includes a dispensing opening and is configured to house a cosmetic product, wherein the advancing mechanism is configured for advancing the cosmetic product from the dispenser body; and a removable cap configured to cover the dispensing opening, wherein a bottom surface of the cap is configured to be in contact with a top surface of the lighter body when the cap covers the dispensing opening;

wherein the dispenser subassembly is removably coupled to the upper portion of the lighter body.

7. The device of claim 6, wherein the upper portion of the lighter body is configured to at least partially surround the dispenser subassembly when coupled to the upper portion of the lighter body.

8. The device of claim 7, further comprising a means for releasably latching the dispenser subassembly to the upper portion of the lighter body.

9. The device of claim 8, further comprising:

a first magnet, and a second magnet, wherein:

the lighter body has a pocket receiving the first magnet, the dispenser body has a pocket receiving the second magnet, and the dispenser subassembly is releasably latched to the upper portion of the lighter body at least by a magnetic attraction between the first and second magnets.

10. The device of claim 6, wherein:

the advancer mechanism includes a spindle having a rotation head and a shaft protruding from the rotation head, the rotation head is at a bottom end of the dispenser body, and the shaft extends inside the dispenser body from the rotation head towards the dispensing opening, and the rotation head is configured to be turned to advance the cosmetic product to protrude from the dispensing opening.

11. The device of claim 10, wherein the upper portion of the lighter body is configured to at least partially surround the dispenser subassembly when coupled to the upper portion of the lighter body, and wherein the upper portion of the lighter body includes openings that allow rotation of the rotation head by a user to advance and retract the cosmetic product.

12. The device of claim 6, further comprising a groove on an outer surface of the lighter body, the groove configured to seat a headphone wire.

13. The device of claim 6, further comprising a flashlight component on the cap.

14. The device of claim 6, further comprising a keychain hole in the cap.

15. The device of claim 6, wherein the upper portion of the lighter body includes grooves for receiving flanges included in the dispensing body.

16. The device of claim 6, wherein the lighter body further comprises a protrusion on an outer surface, the protrusion configured to support a headphone wire.

17. The device of claim 6, wherein the cap includes grooves for receiving flanges included in the dispensing body.

18. A device comprising:

a lighter body with an upper portion and a lower portion, wherein the lower portion includes a lighter mechanism capable of lighting a flame;

a dispenser subassembly comprising a dispenser body and an advancer mechanism, the dispenser body includes a dispensing opening and is configured to house a cosmetic product, wherein the advancing mechanism is configured for advancing the cosmetic product from the dispenser body; and a removable cap configured to cover the dispensing opening, wherein a bottom surface of the cap is configured to be in contact with a top surface of the lighter body when the cap covers the dispensing opening, wherein:

the dispenser subassembly is removably coupled to the upper portion of the lighter body; and the upper portion of the lighter body is configured to at least partially surround the dispenser subassembly when coupled to the upper portion of the lighter body;

the advancer mechanism includes a spindle having a rotation head and a shaft protruding from the rotation head, the rotation head is at the bottom end of the dispenser body, the shaft extends inside the dispenser body from the rotation head towards the dispensing opening, and the rotation head is configured to be turned to advance the cosmetic product to protrude from the dispensing opening; and wherein the upper portion of the lighter body is configured to at least partially surround the dispenser subassembly when coupled to the upper portion of the lighter body, and wherein the upper portion of the lighter body includes openings that allow rotation of the rotation head by a user to advance and retract the cosmetic product.

19. The device of claim 18, further comprising a means for releasably latching the dispenser subassembly to the upper portion of the lighter body.

20. The device of claim 19, further comprising:

a first magnet, and a second magnet, wherein:

the lighter body has a pocket receiving the first magnet, the dispenser body has a pocket receiving the second magnet, and the dispenser subassembly is releasably latched to the upper portion of the lighter body at least by a magnetic attraction between the first and second magnets.

* * * * *